US010645488B2

(12) United States Patent
Devantier et al.

(10) Patent No.: US 10,645,488 B2
(45) **Date of Patent: *May 5, 2020**

(54) RING RADIATOR DRIVER FEATURES

(71) Applicant: Samsung Electronics Co., Ltd., Suwon-si, Gyeonggi-do (KR)

(72) Inventors: Allan Devantier, Valencia, CA (US); Colby J. Buddelmeyer, Los Angeles, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/940,438

(22) Filed: Mar. 29, 2018

(65) Prior Publication Data

US 2018/0227662 A1 Aug. 9, 2018

Related U.S. Application Data

(63) Continuation of application No. 15/371,025, filed on Dec. 6, 2016, now Pat. No. 9,967,656, which is a (Continued)

(51) Int. Cl.
*H04R 1/34* (2006.01)
*H04R 1/02* (2006.01)

(Continued)

(52) U.S. Cl.
CPC ..... *H04R 1/345* (2013.01); *H04R 1/02* (2013.01); *H04R 1/021* (2013.01); *H04R 1/30* (2013.01); *H04R 9/06* (2013.01); *H04R 2201/34* (2013.01)

(58) Field of Classification Search
CPC ..... H04R 2201/34; H04R 1/30; H04R 1/02; H04R 1/34; H04R 1/345; H04R 9/06
See application file for complete search history.

(56) References Cited

U.S. PATENT DOCUMENTS 2,037,187 A 4/1936 Wente
3,912,866 A * 10/1975 Fox ..... H04R 1/2865 381/352

(Continued)

FOREIGN PATENT DOCUMENTS

CN 1219092 A 6/1999
CN 1788524 A 6/2006

(Continued)

OTHER PUBLICATIONS

Chinese Office Action dated Jul. 26, 2018 for Chinese Application No. 201580021664.9 from China Patent Office, pp. 1-22, Beijing, China (English-language translation included pp. 1-13).

(Continued)

*Primary Examiner* — Sunita Joshi
(74) *Attorney, Agent, or Firm* — Sherman IP LLP; Kenneth L. Sherman; Steven Laut

(57) ABSTRACT

An omni-directional speaker includes a speaker enclosure including a sound wave exit configured to emit sound waves omni-directionally. A transducer is coupled to the speaker enclosure. The transducer including a speaker diaphragm coupled to a mounting plate. A phase plug directs sound to the sound wave exit. The phase plug including a first portion that extends outwards toward an exterior of the speaker enclosure.

20 Claims, 29 Drawing Sheets

Related U.S. Application Data continuation of application No. 14/297,829, filed on Jun. 6, 2014, now Pat. No. 9,549,237.

(60) Provisional application No. 61/986,686, filed on Apr. 30, 2014.

(51) Int. Cl.
*H04R 1/30* (2006.01)
*H04R 9/06* (2006.01)

(56) References Cited

U.S. PATENT DOCUMENTS

| | | | | |
|---|---|---|---|---|
| D256,110 | S | 7/1980 | Dunbar et al. | |
| 4,908,601 | A | 3/1990 | Howze | |
| 5,306,880 | A * | 4/1994 | Coziar | H04R 1/345 181/149 |
| 5,451,726 | A | 9/1995 | Haugum | |
| D421,216 | S | 2/2000 | Abrams et al. | |
| D471,532 | S | 3/2003 | Solland | |
| D478,681 | S | 8/2003 | Newcomb | |
| 6,603,862 | B1 * | 8/2003 | Betts | H04R 1/345 181/155 |
| D479,833 | S | 9/2003 | Chen | |
| D480,382 | S | 10/2003 | Solland | |
| 7,433,483 | B2 | 10/2008 | Fincham | |
| D603,374 | S | 11/2009 | Peters | |
| D640,667 | S | 6/2011 | Lee et al. | |
| 8,027,500 | B2 | 9/2011 | Fincham | |
| D716,764 | S | 11/2014 | Jeon et al. | |
| D724,570 | S | 3/2015 | Kusano et al. | |
| D725,632 | S | 3/2015 | Zhao | |
| 2007/0017915 | A1 | 1/2007 | Weder et al. | |
| 2011/0204049 | A1 | 8/2011 | Weder et al. | |
| 2012/0201403 | A1 * | 8/2012 | Tan | H04R 1/345 381/182 |

FOREIGN PATENT DOCUMENTS

| | | | |
|---|---|---|---|
| CN | 204316742 | U | 5/2015 |
| EP | 0909111 | B1 | 12/2005 |
| JP | 2008182481 | A | 8/2008 |
| KR | 1020030075605 | A | 9/2003 |
| KR | 1020080068289 | | 7/2008 |
| KR | 200444208 | Y1 | 4/2009 |
| KR | 20100005398 | A | 1/2010 |

OTHER PUBLICATIONS

International Search Report and Written Opinion dated Jul. 30, 2015 for International Application No. PCT/KR2015/004378 from Korean Intellectual Property Office, pp. 1-10, Daejeon, Republic of Korea.
Extended European Search Report dated Oct. 25, 2017 for European Application No. 15786698.9 from European Patent Office, pp. 1-9, Munich, Germany.
U.S. Restriction Requirement for U.S. Appl. No. 29/491,525 dated Aug. 14, 2015.
U.S. Non-Final Office Action for U.S. Appl. No. 29/491,525 dated Nov. 9, 2015.
U.S. Notice of Allowance for U.S. Appl. No. 29/491,525 dated Apr. 6, 2016.
U.S. Corrected Notice of Allowability for U.S. Appl. No. 29/491,525 dated Jun. 14, 2016.
U.S. Non-Final Office Action for U.S. Appl. No. 14/297,829 dated Oct. 21, 2015.
U.S. Final Office Action for U.S. Appl. No. 14/297,829 dated Apr. 6, 2016.
Advisory Action for U.S. Appl. No. 14/297,829 dated Jun. 13, 2016.
Notice of Allowance for U.S. Appl. No. 14/297,829 dated Sep. 20, 2016.
U.S. Non-Final Office Action for U.S. Appl. No. 15/371,025 dated May 18, 2017.
U.S. Final Office Action for U.S. Appl. No. 15/371,025 dated Oct. 30, 2017.
U.S. Notice of Allowance for U.S. Appl. No. 15/371,025 dated Jan. 5, 2018.
U.S. Corrected Notice of Allowability for U.S. Appl. No. 29/491,525 dated Jul. 7, 2016.
Indian Office Action dated Oct. 21, 2019 for Indian Application No. 201627031972 from Intellectual Property India, pp. 1-5, Mumbai, India (English-language translation included).
European Office Action dated Aug. 8, 2019 for European Application No. 15786698.9 from European Patent Office, pp. 1-6, Munich, Germany.

* cited by examiner

RING RADIATOR DRIVER FEATURES

CROSS-REFERENCE TO RELATED APPLICATIONS

This application is a continuation of U.S. patent application Ser. No. 15/371,025, filed on Dec. 6, 2016, which claims the benefit of U.S. Pat. No. 9,549,237 (application Ser. No. 14/297,829), filed on Jun. 6, 2014, which claims the priority benefit of U.S. Provisional Patent Application Ser. No. 61/986,686, filed Apr. 30, 2014, each of which is incorporated herein by reference in its entirety.

TECHNICAL FIELD

One or more embodiments relate generally to audio speakers, and in particular, to radiator audio drivers for sound reproduction.

BACKGROUND

Speakers may be used for sound reproduction when connected with receivers (e.g., stereo receivers, surround receivers, etc.), television (TV) sets, radios, music players, electronic sound producing devices (e.g., smartphones), video players, etc. Conventionally, speakers send most of the reproduced sound forward from the speaker cone, horn or other device.

SUMMARY

One or more embodiments relate to radiator drivers. In some embodiments, an omni-directional speaker apparatus includes a speaker enclosure including a sound wave exit configured to emit sound waves omni-directionally. A transducer is coupled to the speaker enclosure. The transducer including a speaker diaphragm coupled to a mounting plate. A phase plug directs sound to the sound wave exit. The phase plug including a first portion that extends outwards toward an exterior of the speaker enclosure.

In one or more embodiments, an omni-directional speaker system comprises a speaker enclosure including a first sound wave exit and a second sound wave exit to emit sound waves omni-directionally. A first transducer is coupled to the speaker enclosure. The first transducer comprising: a speaker diaphragm coupled to a mounting plate, and a first phase plug that directs sound to the first sound wave exit. The first phase plug comprising a first portion positioned adjacent to at least part of the speaker diaphragm and a second portion that extends outwards toward an exterior of the speaker enclosure. The omni-directional speaker system also includes a second radiator driver.

In one or more embodiments, a method comprises positioning a sound wave exit on a speaker enclosure to emit sound waves omni-directionally. A transducer is attached to the speaker enclosure. The speaker transducer including a speaker diaphragm having a portion coupled to a mounting plate disposed adjacent the sound wave exit. The method further includes positioning a first portion of a phase plug that directs sound to the sound wave exit adjacent to at least part of the speaker diaphragm. Additionally, the method includes positioning a second portion of the phase plug that extends outwards toward an exterior of the speaker enclosure.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments provide for speakers/transducers, including radiator compression drivers. In one embodiment, a speaker includes an enclosure including a peripheral sound wave exit. A compression driver is connected to the speaker enclosure. Sound waves are peripherally spread from the peripheral sound wave exit of the speaker enclosure.

Figure 1A:
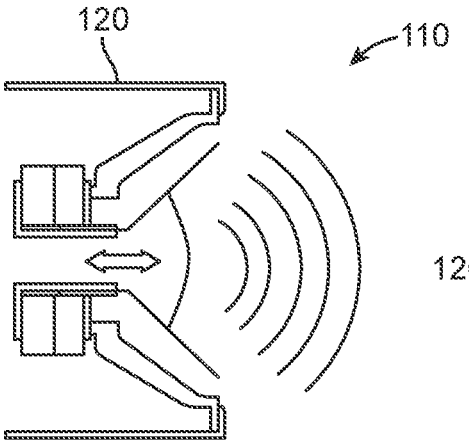
FIG. 1A (Prior Art)
FIG. 1A shows a conventional forward sound producing speaker.
Figure 1B:
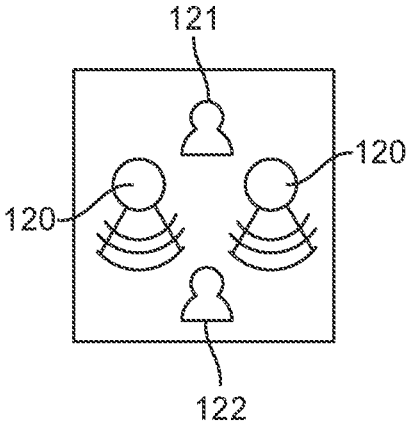
FIG. 1B (Prior Art)
FIG. 1B shows conventional forward sound producing speakers in a listening environment.

FIG. 1A shows a conventional forward sound producing speaker 120 that produces sound 110 in a forward direction from the speaker 120. FIG. 1B shows conventional forward sound producing speakers 120 in a listening environment with two listeners 121 and 122. The speaker 120 is typically placed in front of or behind listening points of one or more users. As illustrated, the listener 121 is positioned behind the two speakers 120 and the listener 122 is positioned in front of the two speakers 120. As the sound is produced from the speakers 120, the sound travels forward from the speakers. As shown, the listener 121 is behind the emanating sound and may not be able to hear a portion of the sound.

Figure 2A:
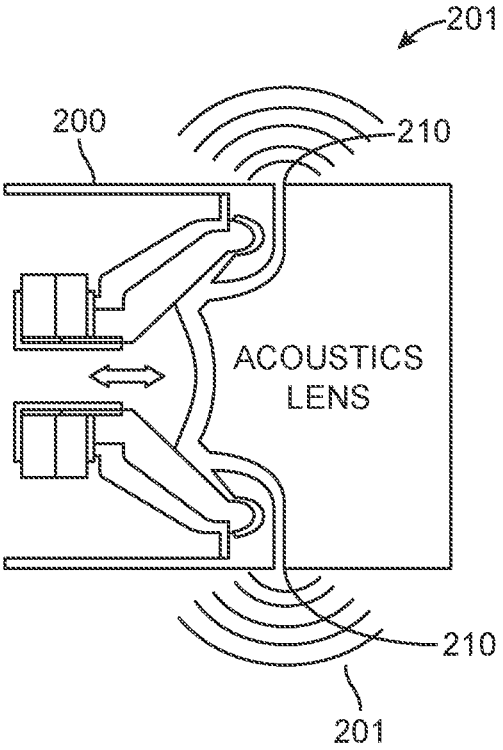
FIG. 2A shows an example speaker implementing a ring radiator compression driver and spreading sound evenly from a speaker enclosure, according to an embodiment.
Figure 2B:
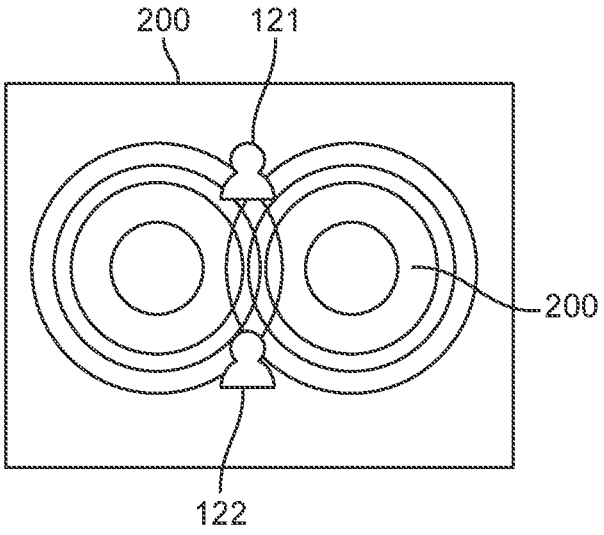
FIG. 2B shows example speakers each implementing a ring radiator compression driver and spreading sound evenly in a listening environment, according to an embodiment.

FIG. 2A shows an example speaker 200 implementing a ring radiator compression driver and spreading sound 201 evenly from an exit/opening 210 of a speaker enclosure, according to an embodiment. FIG. 2B shows example speakers 200 each implementing a ring radiator compression driver and spreading sound evenly in a listening environment for listeners 121 and 122, according to an embodiment. One or more embodiments may include speaker housings that include a sound wave exit 210 that is in the shape of a ring in a speaker enclosure that may be of spherical, elliptical, oval, or polygonal, etc., shape. Therefore, many example embodiments provide a high-efficiency omni-directional loudspeaker device. The speakers 200 may include various types of speaker components, such as high-frequency speakers (e.g., tweeters), mid-frequency speakers (midrange) and low-frequency speakers (e.g., woofers).

As shown in FIG. 2B, the listeners 121 and 122 both may listen to sound from the speakers 200 with the same emersion in sound waves as the sound emanating from the speakers 200 exit the speakers 200 from the perimeter exit 210, as opposed to conventional speakers 120 (FIGS. 1A-B) that only produce forward emanating sound waves.

A speaker driver is known as an individual transducer that converts electrical energy to sound waves, and may be part of a loudspeaker, television, or other electronics device. The transducer may also be referred to as a speaker, such as when a single one is mounted in an enclosure or used by itself (e.g., surface-mounted, ceiling mounted, wall mounted, etc.). Common drivers may include a woofer, mid-range, tweeter, sub-woofer, and super-tweeter.

Typically, speaker drivers include a diaphragm that moves back and forth to create pressure waves. The diaphragm may be in the shape of a cone for low and mid frequencies or a dome for higher frequencies. Speaker drivers may be made of coated or uncoated paper, polypropylene plastic, woven fiberglass, carbon fiber, aluminum, titanium, PEI, polyimide, PET film, plastic film as the cone, dome or radiator.

Speaker drivers have a means of electrically inducing back-and-forth motion. Typically there is a tightly wound coil of insulated wire (voice coil) attached to the neck of the driver's cone. Typically, the cone, dome or other sound radiator is mounted to a rigid frame which supports a permanent magnet in close proximity to the voice coil. Other typical components are a spider or damper, used as the rear suspension element, terminals or binding posts to connect the audio signal, and a surround or gasket to seal the joint between the chassis and enclosure.

Figure 3A:
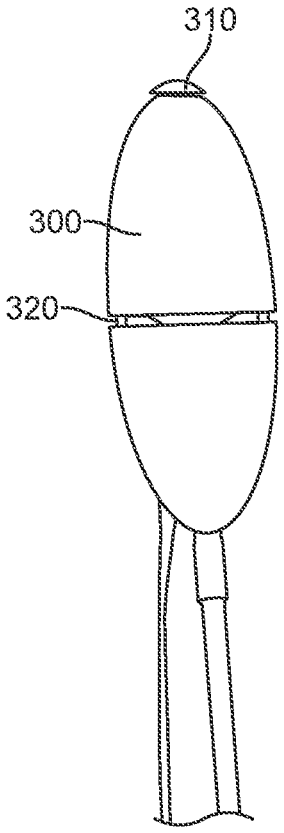
FIGS. 3A-B show example views of an embodiment including a two-way loudspeaker implementing a ring radiator compression driver shown in an upright position with an exemplary speaker stand, according to an embodiment.
Figure 3B:
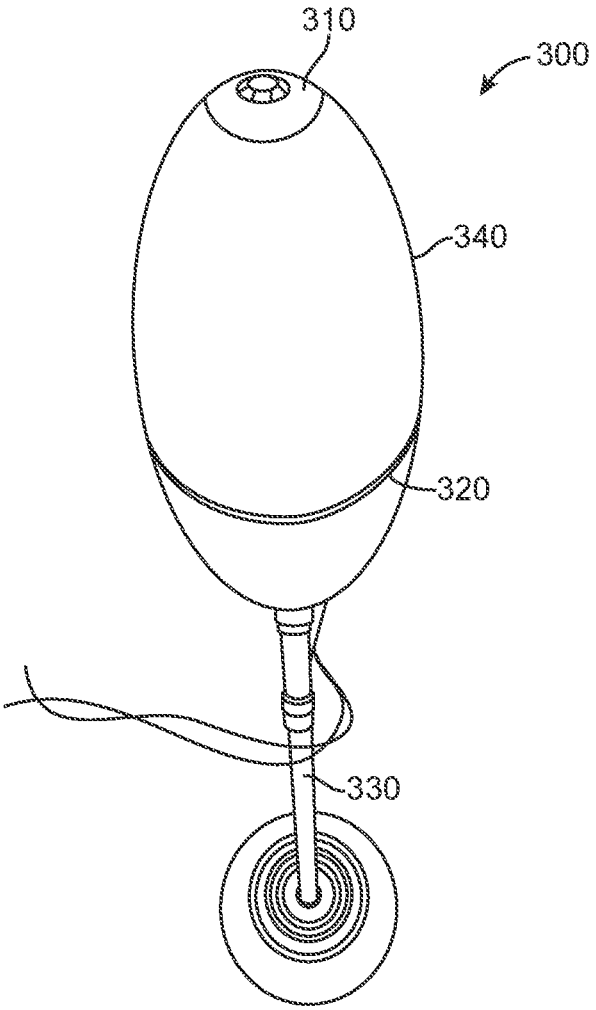

FIGS. 3A-B show example views of an embodiment including a two-way loudspeaker 300 implementing a ring radiator compression driver shown in an upright position with an exemplary speaker stand 330, according to an embodiment. In one example, the lower gap/opening comprises an air/sound wave exit 320 where a phase plug is positioned over a driver (e.g., a woofer cone) and a high-frequency speaker (e.g., tweeter) is positioned near the top of the housing 340 with an exit 310. In one example, the upper exit 310 (gap/opening) has a smaller diameter than the lower exit 320.

In one example, the loudspeaker 300 shown in FIGS. 3A-B has a 360 degree dispersion of sound through the exit 320 (gap/opening). In another example, the loudspeaker 300 may include a unique form factor that does not have visible transducers. Additionally, the loudspeaker does not require or necessitate a protection grill (e.g., to avoid dust). One or more embodiments provide loudspeaker designs for loudspeakers that include ring compression drivers with one or more phase plugs that may be implemented in: high end speakers, home theater, soundbars, personal speakers, wireless multi-zone speakers, monitors, professional music systems, etc.

One or more embodiments include a phase plug 410 (FIG. 4) that creates a compression driver. In one embodiment, the surface of the phase plug 410 is as close as possible to the speaker diaphragm without the speaker cone contacting the phase plug 410. The phase plug 410 directs the sound to an exit (e.g., exit 320) that is in the shape of a ring or peripheral/perimeter of an enclosure or housing (e.g., housing/enclosure 340). The ring-like exit (e.g., exit 320) may be part of a spherical, elliptical, cylindrical, polygonal, etc., speaker/loudspeaker enclosure.

In one embodiment, the length of the phase plug 410 is minimized to improve the frequency response. The phase plug can increase the dynamic mass of the diaphragm, which may be used in the design of the transducer.

Figure 4:
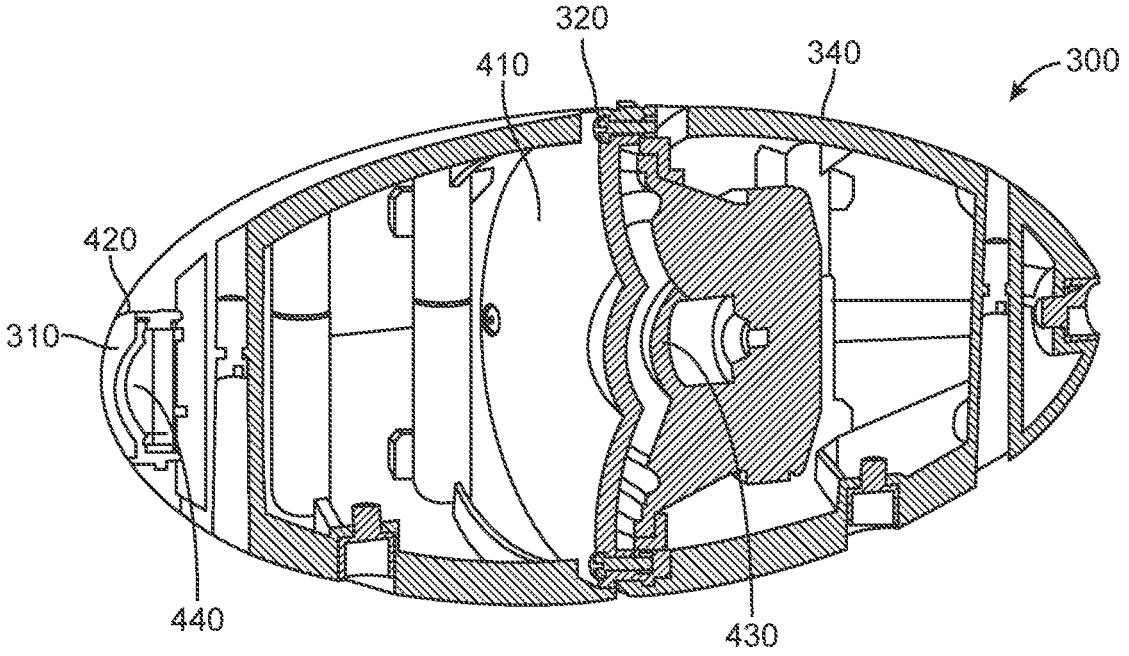
FIG. 4 shows a cut-out view of an example elliptical speaker enclosure implementing a ring radiator compression driver, according to an embodiment.

FIG. 4 shows a cut-out view of an example elliptical speaker enclosure 340 implementing a ring radiator compression driver 410 for speaker 300, according to an embodiment. In one example, the speaker 300 shown includes a woofer towards the center and tweeter towards one end of the housing. In one example, speaker 300 includes one phase plug 410 that is positioned above the woofer 430 diaphragm, and another phase plug 420 is positioned above the tweeter 440 diaphragm. In one embodiment, the circumferential gaps/exits 310 and 320 provide for sound from the tweeter and woofer, respectively, to each be dispersed 360 degrees outwards from the speaker housing 340.

Figure 5:
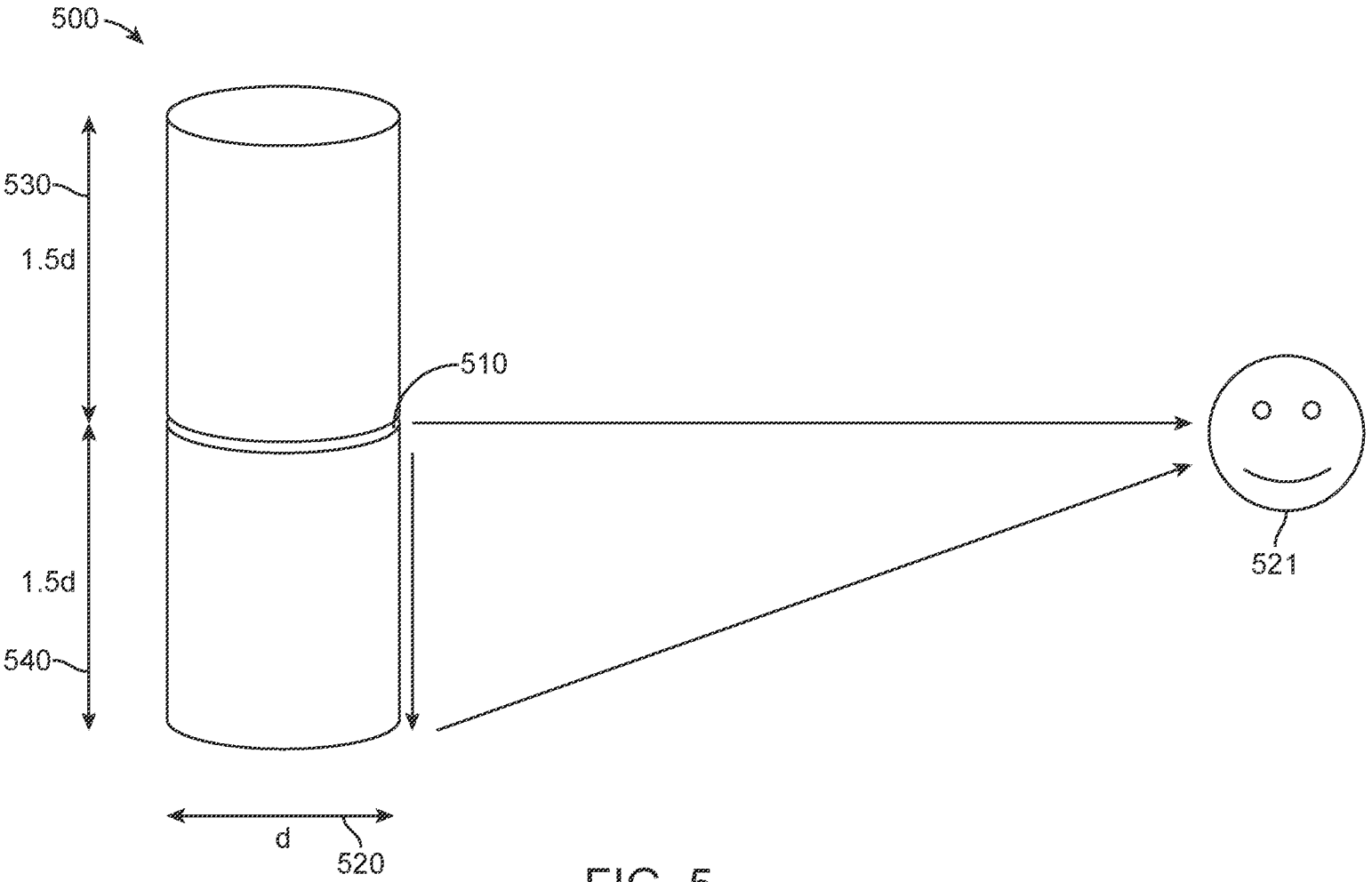
FIG. 5 shows a diagram for a cylindrical speaker enclosure implementing a ring radiator compression driver showing example height and diameter, according to an embodiment.

FIG. 5 shows a diagram for a cylindrical speaker 500 implementing a ring radiator compression driver showing example height (references 530 and 540 combined) and diameter (d) 520, according to an embodiment. In one example, the cylindrical speaker enclosure has a height (h)=2×1.5×diameter 520 (+/−10 percent). As shown, the placement of the exit 510 for sound is about 1.5×d 520 of the base of the cylindrical enclosure. In one example, the minimum diameter for creating quality bass (e.g., from a woofer) from a listeners sound-point 521 is about 70 mm, and the maximum diameter for quality highs (e.g., from a tweeter) is about 85 mm.

Figure 6:
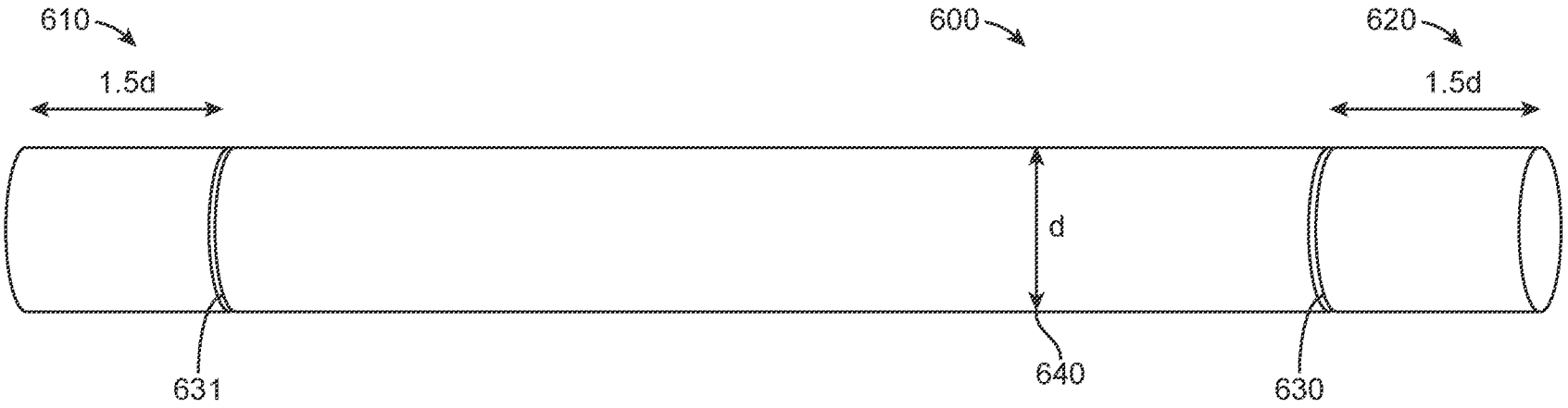
FIG. 6 shows a diagram for a cylindrical soundbar speaker implementing ring radiator compression drivers near the two ends of the soundbar showing example length and diameter, according to an embodiment.

FIG. 6 shows a diagram for a cylindrical soundbar speaker 600 implementing ring radiator compression drivers near the two ends of the soundbar speaker showing example lengths 610 and 620 and diameter (d) 640, according to an embodiment. In one example, the placement of the exits 630 and 631 for sound is about 1.5×d 640 (the diameter of the base of the cylindrical enclosure) from either end of the soundbar speaker 600.

Figure 7:
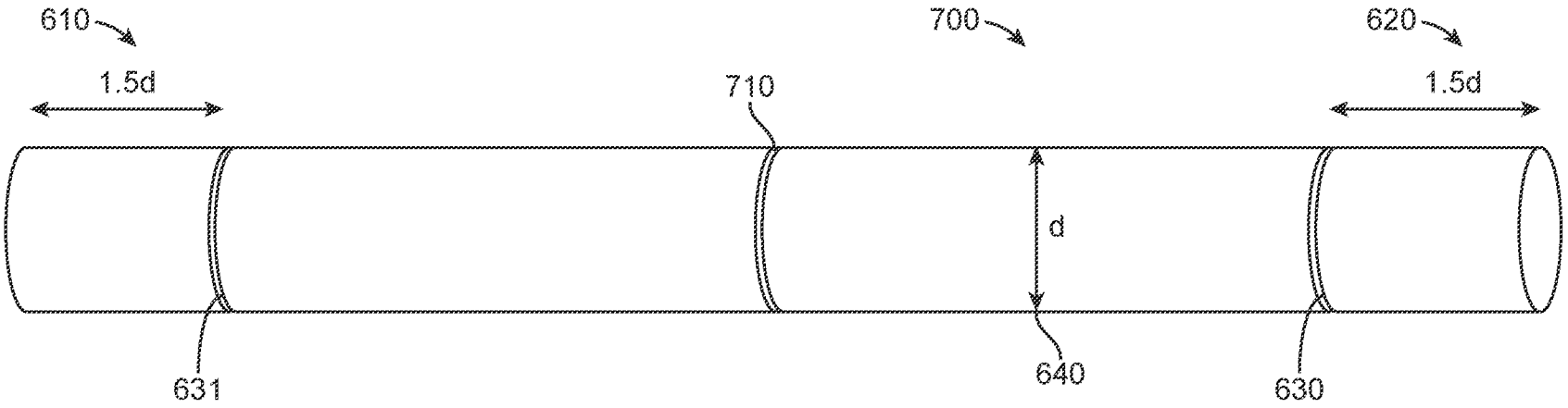
FIG. 7 shows a diagram for a cylindrical soundbar speaker implementing ring radiator compression drivers near the two ends and a center speaker of the soundbar showing example length and diameter, according to an embodiment.

FIG. 7 shows a diagram for a cylindrical soundbar speaker 700 implementing ring radiator compression drivers near the two ends and a center speaker of the soundbar speaker 700 showing example lengths 610 and 620 and diameter (d) 640, according to an embodiment. In one example, the placement of the exits 630 and 631 for sound waves for the end speakers is each about 1.5×d 640 of the base of the cylindrical enclosure from either end of the soundbar speaker 700. The center exit 710 is simply centered within the soundbar speaker 700.

Figure 8:
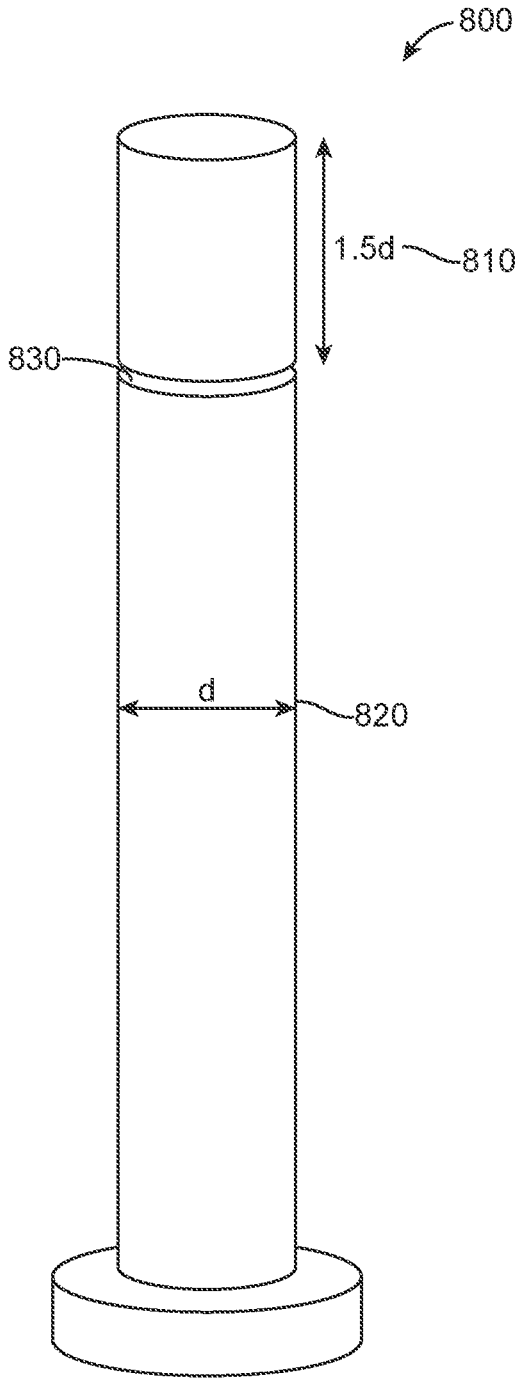
FIG. 8 shows a diagram for a cylindrical tower speaker implementing a ring radiator compression driver showing example height and diameter, according to an embodiment.

FIG. 8 shows a diagram for a cylindrical tower speaker 800 implementing a ring radiator compression driver showing example height (from the top of the enclosure) 810 and diameter (d) 820, according to an embodiment. In one example, the placement of the exit 830 for sound is about 1.5×d 820 (the diameter of the base of the cylindrical housing) from the top of the cylindrical tower speaker 800.

Figure 9:
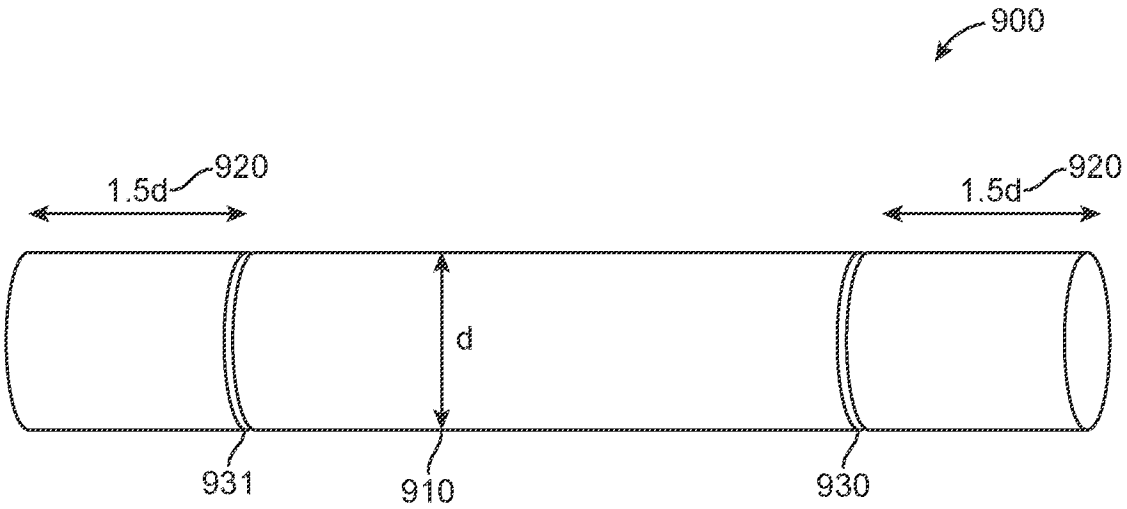
FIG. 9 shows an example diagram for a wireless cylindrical speaker enclosure implementing a ring radiator compression driver that includes a speaker positioned at each of the ends, according to an embodiment.

FIG. 9 shows an example diagram for a wireless cylindrical speaker 900 having an enclosure that implements a ring radiator compression driver and includes a speaker positioned at each of the ends, according to an embodiment. In one example, the placement/distance 920 of the exits 930 and 931 for sound is about 1.5×the diameter (d) 910 of the base of the cylindrical enclosure from either end of the wireless speaker 900. In one embodiment, the wireless cylindrical speaker 900 includes a wireless receiver for receiving audio communication from a transmitting device (e.g., a wireless transmitter connected to an electronic device, such as a receiver, radio, smart audio device or telephone, television device, etc.).

Figure 10:
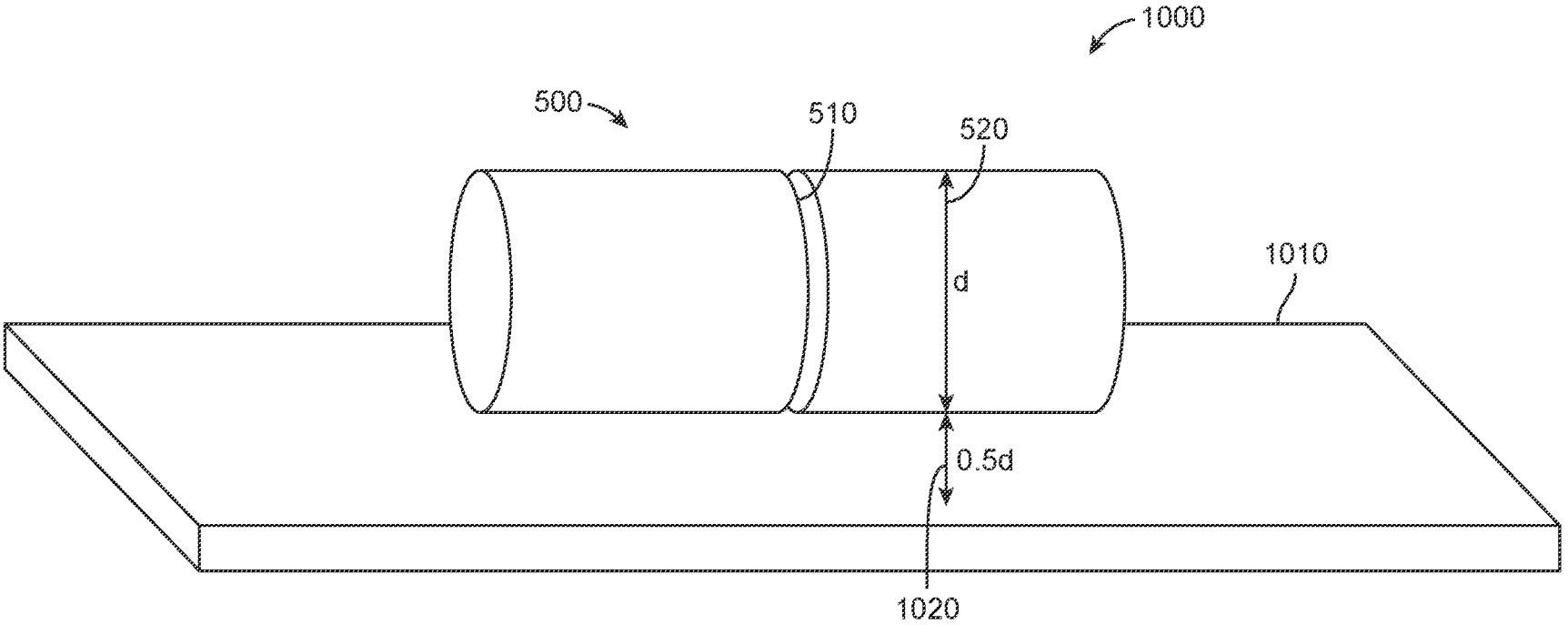
FIG. 10 shows an example of a table mounting diagram for a speaker implementing a ring radiator compression driver, according to an embodiment.

FIG. 10 shows an example 1000 of a table mounting diagram for a speaker 500 implementing a ring radiator compression driver, according to an embodiment. In one example, the placement/distance 1020 of the enclosure above the surface of the table 1010 (or any similar type of structure) is about 0.5 times d 520 (the diameter of the speaker enclosure, e.g., a cylindrical speaker enclosure). In one example, the height 1010 of 0.5×d 520 provides enough space around the speaker enclosure to provide for sound waves to emanate from the ring-like exit 510 around the enclosure to minimize blocking or interfering with sound waves from the ring-like exit 510 portion closest to the table 1010.

Figure 11:
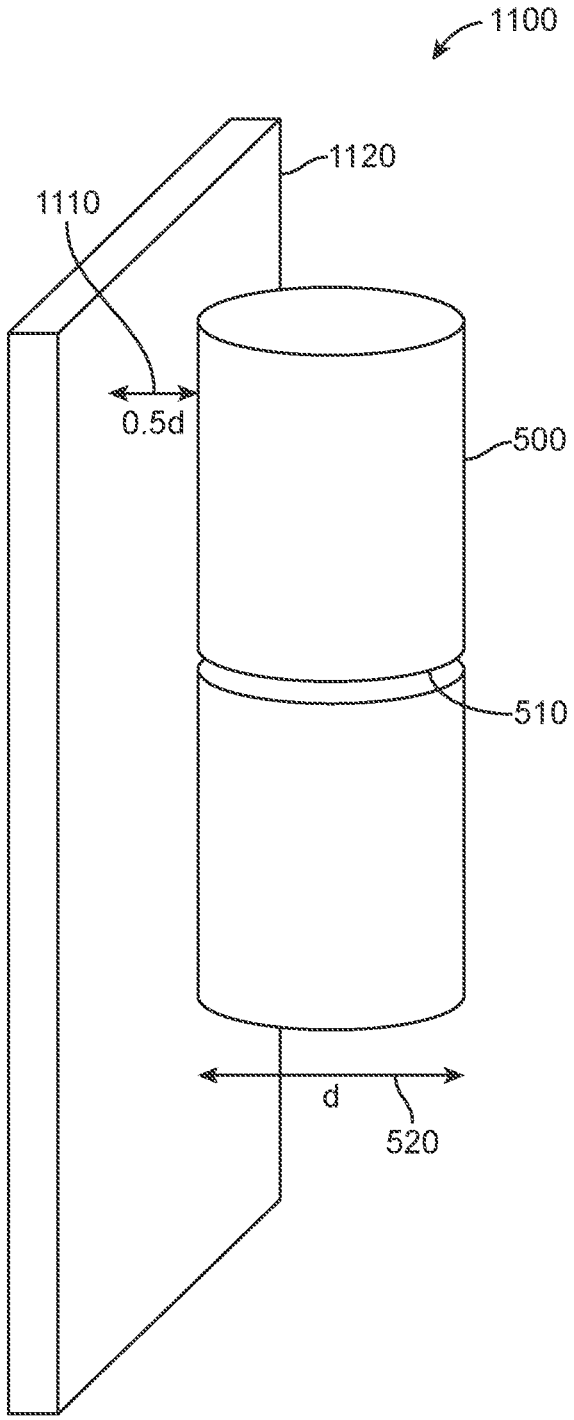
FIG. 11 shows an example of a wall mounting diagram for a speaker implementing a ring radiator compression driver, according to an embodiment.

FIG. 11 shows an example 1100 of a wall mounting diagram for a speaker 500 implementing a ring radiator compression driver, according to an embodiment. In one example, the placement of the enclosure away from the surface of the wall 1120 (or other similar structure) is about 0.5×d 520 (the diameter of the speaker enclosure, e.g., a cylindrical speaker enclosure). In one example, the distance 1110 of 0.5×d 520 provides enough space around the speaker enclosure to provide for sound waves to emanate from the ring-like exit 510 around the enclosure without blocking or interfering with sound waves from the portion of the ring-like exit 510 closest to the wall 1120.

Figure 12:
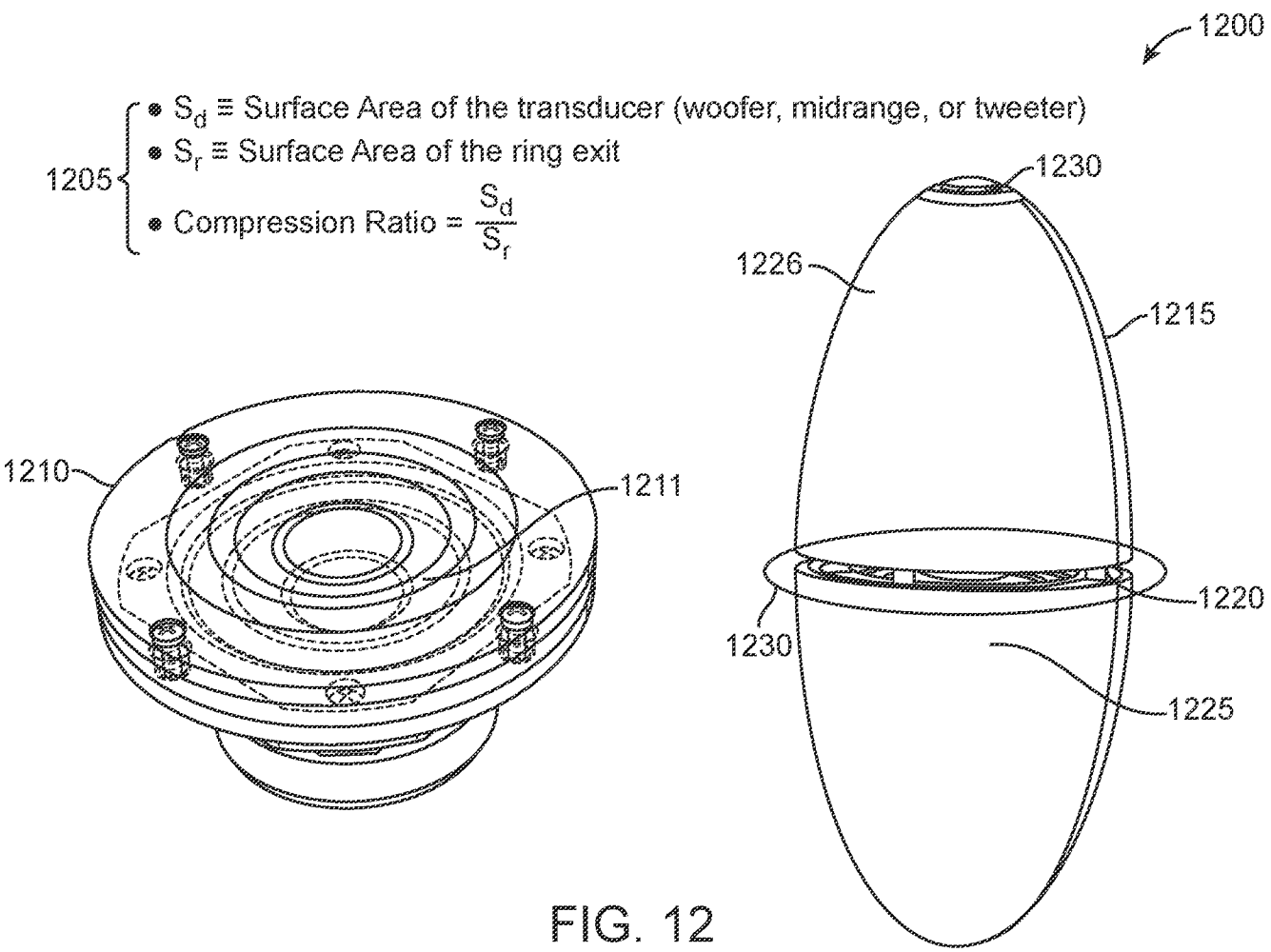
FIG. 12 shows calculation of the compression ratio used to design one or more speaker systems implementing a ring radiator compression driver, according to an embodiment.

FIG. 12 shows a diagram 1200 for calculation of the compression ratio 1205 used to design one or more speaker systems implementing a ring radiator compression driver, according to an embodiment. The surface area of the transducer (e.g., woofer 1210, midrange or tweeter 1226 (with exit 1230)) of a speaker 1215 with an enclosure 1225 is represented as $S_d$. Additionally, if a dust cap is used, the surface area of the cone and the dust cap may be represented as $S_d$ 1211. The surface area 1230 of the ring-like exit is represented as $S_r$. In one embodiment, the compression ratio 1205 equals $S_d/S_r$. In one or more embodiments, the size of the ring-like exit 1220 of the enclosure 1215 is optimized to obtain a compression ratio 1205 that may improve efficiency of speaker system designs for filling areas with sound.

For understanding the details of the following figures, in a slotted speaker design that is used in one or more embodiments, it is advantageous to keep the path length from where the sound is produced (e.g., within the enclosure) to the exit of the enclosure as short as possible. In one embodiment, if the sound is directed to the outside air though the same slot in which the sound is produced, then this type of design is referred to herein as "end tapped." One way to shorten the apparent path length and thereby improve the design is to force the sound to exit from a slot (or throat) that is located at the geometric half radius (or other radius position based on design calculations depending on components, such as ⅓, ⅔, ⅖, etc.) from the slot in which the sound is being produced. This type of design is referred to herein as "center tapped." Additionally, it is also possible that additional improvement may be obtained by adding additional taps. The following figures show different designs, which may include end tapped, one tap, two taps, etc. and show the geometric relations.

It should be noted that one or more embodiments include path lengths that are designed to be specific lengths. Path length for sound travel from the speaker to the exit is important for the following reasons. The path length for the sound waves to travel through to the exit affects the audio quality. The reflections of the sound in the throat generate comb filtering and standing waves, which cause peaks and dips in the amplitude response of the speaker. It is important to keep the path length short and also to keep symmetry in the path lengths. Thus, it is advantageous to tap the audio at a halfway point between the center and the outer edge of the transducer, according to one or more embodiments. Additional benefit may also be gained from adding more tap points at equally spaced points, which maintain equal path lengths between the taps.

Figure 13:
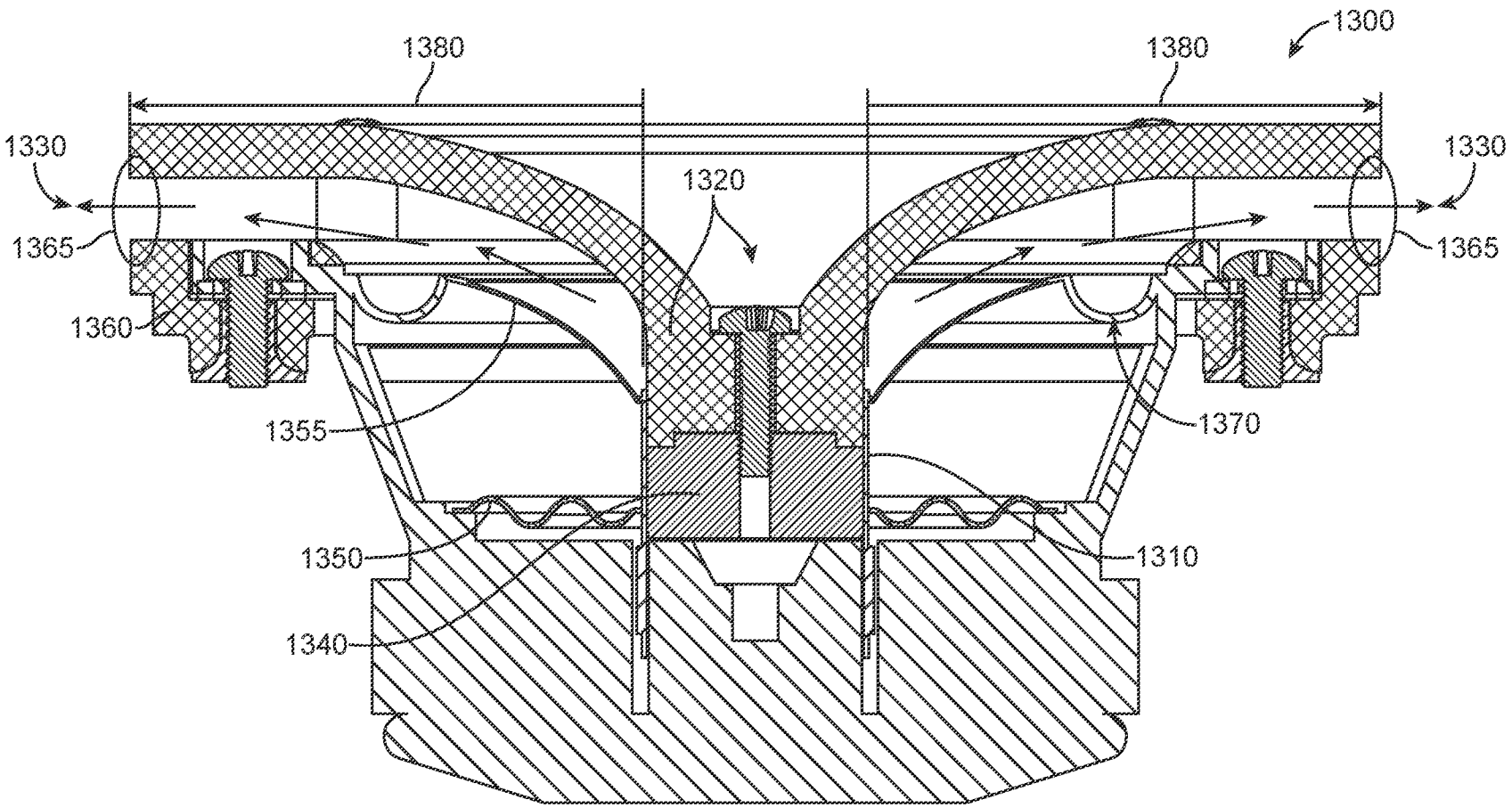
FIG. 13 shows an end tapped cone speaker with a center pole phase plug, according to an embodiment.

FIG. 13 shows an end tapped cone speaker 1300 (e.g., a woofer) with a center pole phase plug 1320, according to an embodiment. In one embodiment, the phase plug 1320 extends inside the voice-coil 1310 in order to shut-off flow of the air 1330. In this way, the throat starts approximately at the diameter of the voice-coil 1310. This in turn reduces the longest path length 1380. In one embodiment, a phase plug adapter 1340 is used to allow for designing with different exit 1365 heights while allowing use of the same phase plug 1320 (i.e., the phase plug may be extended or retracted to determine sound quality and efficiency in speaker design).

In one embodiment, the cone 1355 of the speaker 1300 moves forward and back (with the help of the spider 1350) and compresses the sound between the cone 1355 and the phase plug 1320 and forces the sound waves out of the exit 1365 (surrounding the enclosure). The view of the phase plug 1320 is an un-sectioned view of the top surface. Additionally, the surround 1370 and transducer mounting plate 1360 are shown for detail.

Figure 14:
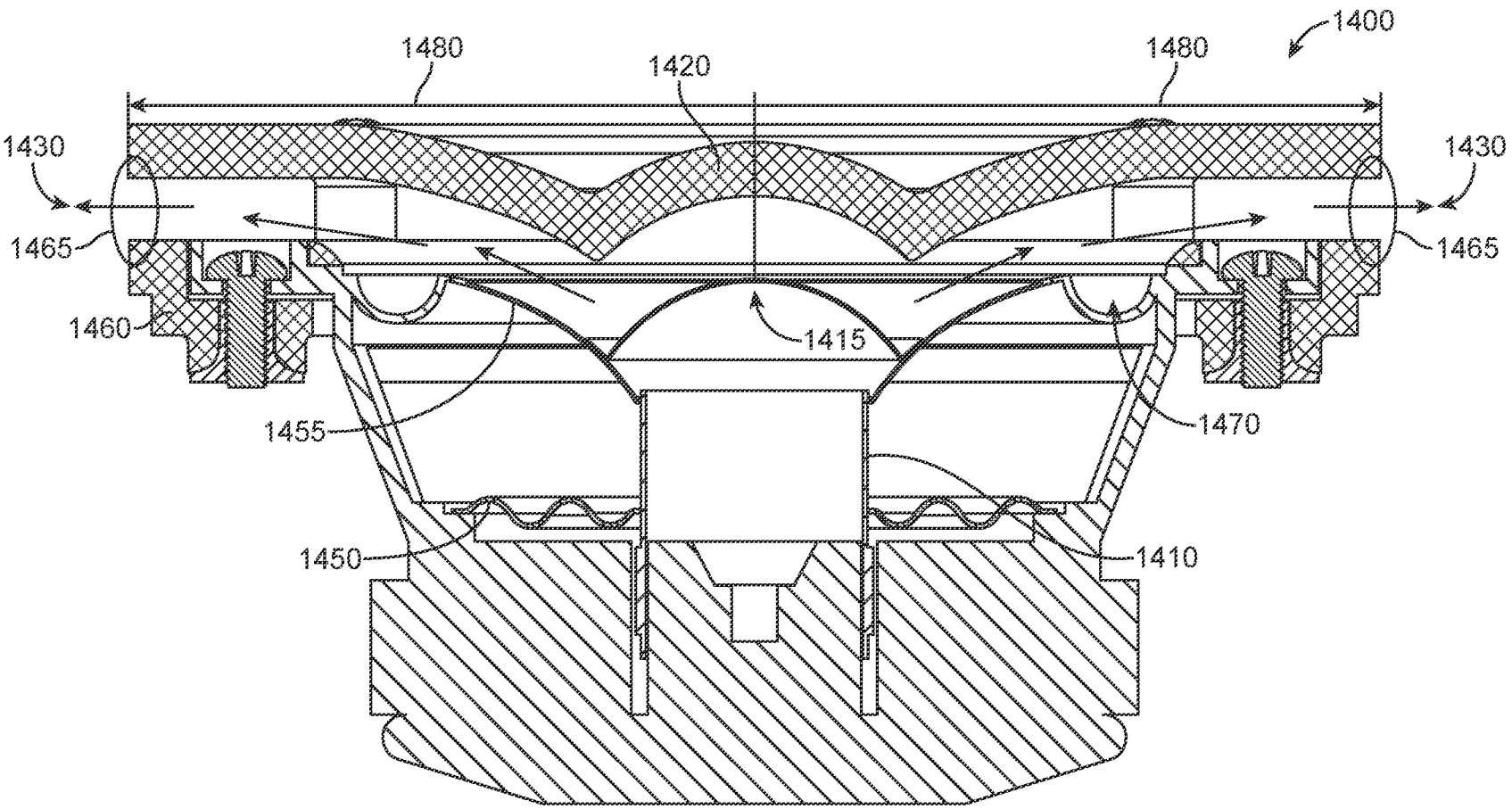
FIG. 14 shows an end tapped cone speaker with a domed center phase plug, according to an embodiment.

FIG. 14 shows an end tapped cone speaker 1400 (e.g., a woofer) with a domed center phase plug 1420, according to an embodiment. In one embodiment, the phase plug 1420 is positioned parallel-like over the dust cap 1415 and extends outward toward the circumference of the speaker enclosure. The path length 1480 is shown from the center of the dust cap 1415. In one embodiment, the cone 1455 and dust cap 1415 of the speaker 1400 moves forward (i.e., upward) and back downward (with the help of the spider 1450), and compresses the sound between the cone 1455 with the dust cap 1415 and the phase plug 1420 for forcing the sound waves 1430 out of the exit 1465 (surrounding the enclosure). Additionally, the voice coil 1410, surround 1470 and transducer mounting plate 1460 are shown for detail.

Figure 15:
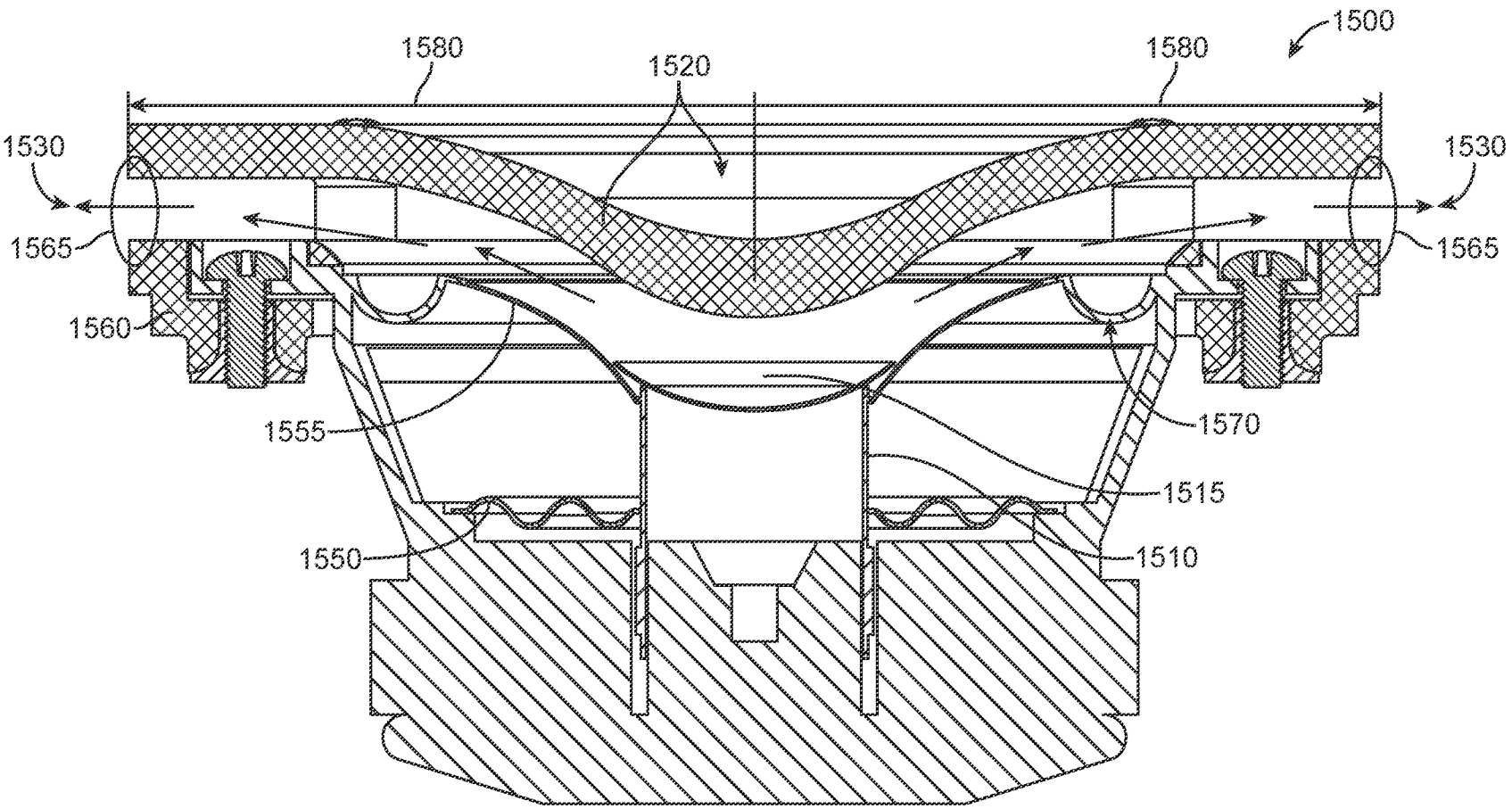
FIG. 15 shows an end tapped cone speaker with an inverted domed center phase plug, according to an embodiment.

FIG. 15 shows an end tapped cone speaker 1500 (e.g., a woofer) with an inverted domed center phase plug 1520, according to an embodiment. In one embodiment, a portion of the phase plug 1520 is positioned parallel-like over the cone 1555 and inverted dust cap 1515, and the remaining portion extends outward toward the circumference of the speaker enclosure. The path length 1580 is shown from the center of the inverted dust cap 1515. In one embodiment, the cone 1555 of the speaker 1500 with the inverted dust cap 1515 moves forward (i.e., upward) and back downward (with the help of the spider 1550), and compresses the sound between the cone 1555 and the phase plug 1520 for forcing the sound waves 1530 out of the exit 1565 (surrounding the enclosure). Additionally, the voice coil 1510, surround 1570 and transducer mounting plate 1560 are shown for detail.

Figure 16:
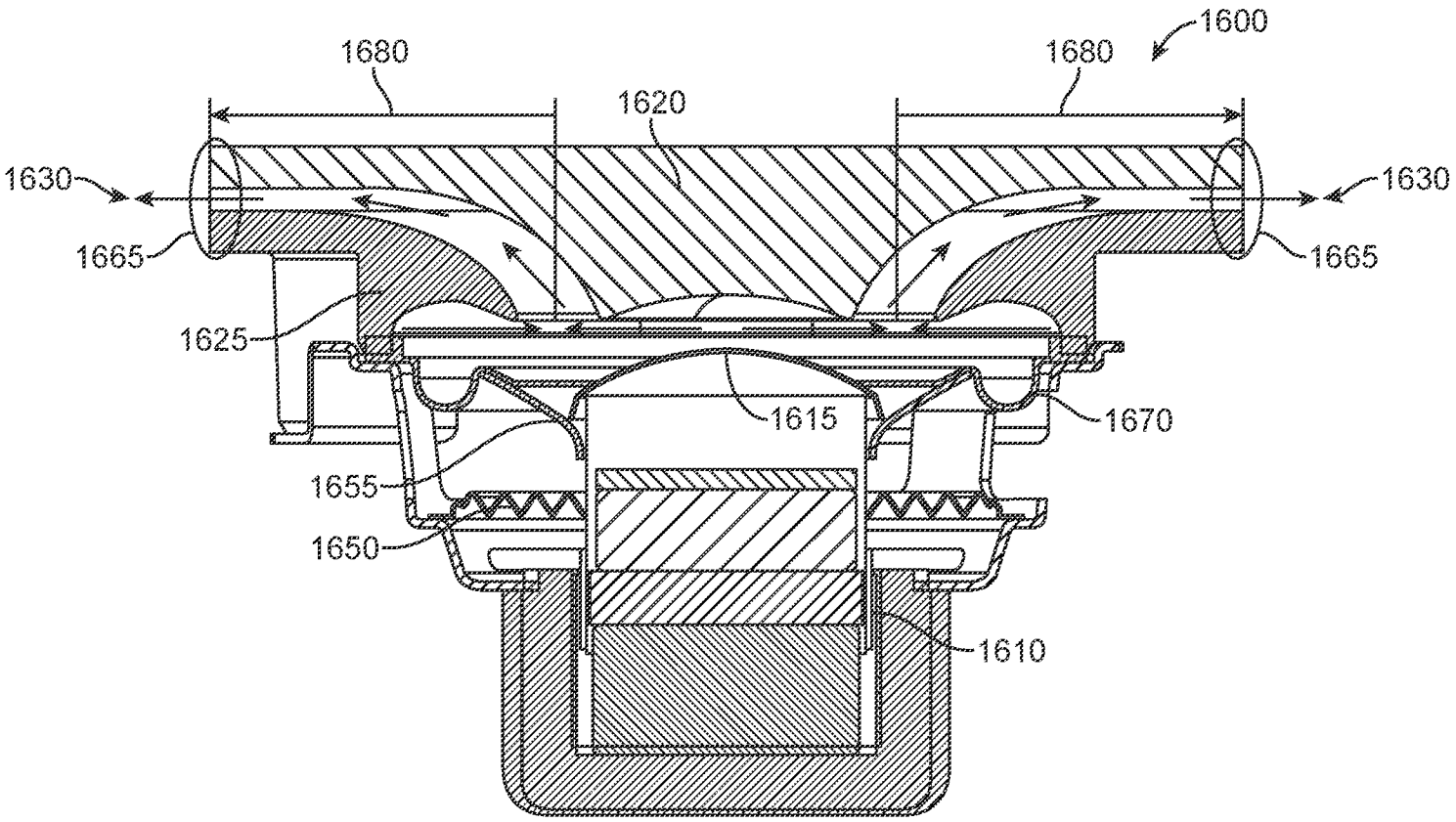
FIG. 16 shows a center tapped cone speaker with a domed center phase plug, according to an embodiment.

FIG. 16 shows a center tapped cone speaker 1600 (e.g., a woofer) with a domed center phase plug 1620, according to an embodiment. In one embodiment, a portion of the phase plug 1620 is positioned over the dust cap 1615, and the remaining portion extends outward toward the circumference of the speaker enclosure and includes the center tapped paths that curve outward toward the circumference of the speaker enclosure and out through the exit 1665. The path length 1680 is shown from the outside of the dust cap 1615. In one embodiment, the cone 1655 and dust cap 1615 of the speaker 1600 moves forward (i.e., upward) and back downward (with the help of the spider 1650), and compresses the sound between phase plug 1620 and the cone 1655 and dust cap 1615 for forcing the sound waves 1630 out through the air paths (having path lengths 1680) to the exit 1665 (surrounding the enclosure). As shown, the sound waves 1630 are directed from the center tapped cone speaker 1600, and multiple directions are combined to be directed through the air paths to the exit 1665. Additionally, the voice coil 1610, surround 1670 and phase plug bottom 1625 are shown for detail.

Figure 17:
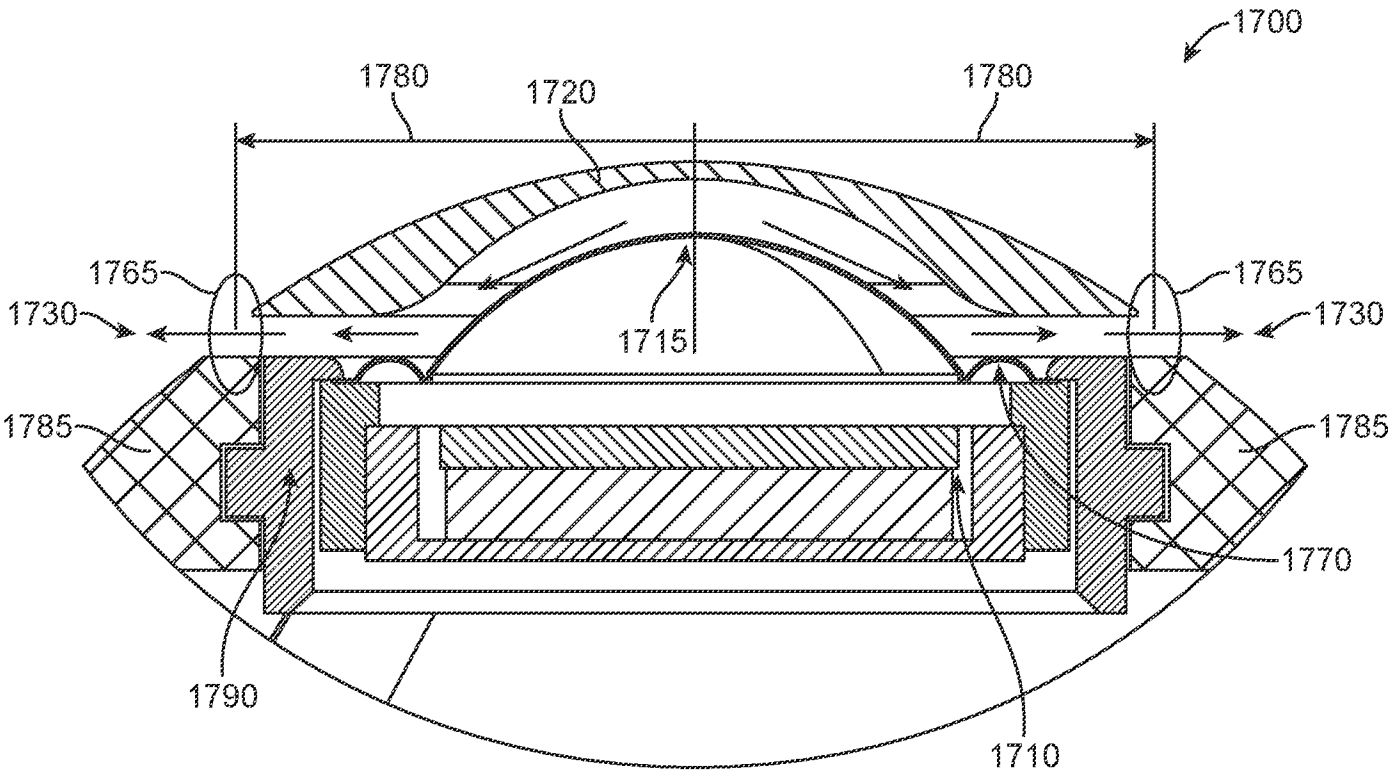
FIG. 17 shows a dome speaker with an end tap phase plug, according to an embodiment.

FIG. 17 shows a dome speaker 1700 (e.g., a tweeter) with an end tap phase plug 1720, according to an embodiment. In one embodiment, a portion of the phase plug 1720 is positioned over the speaker dome 1715 and the remaining portion extends outward toward the circumference of the speaker enclosure 1785. The path length 1780 is shown from the center of the speaker dome 1715. In one embodiment, the speaker dome 1715 emanates sound waves 1730 that are compressed between the phase plug 1720 and the speaker dome 1715, and forced out through the air paths to the exit 1765 (surrounding the enclosure). Additionally, voice coil 1710, surround 1770 and tweeter housing 1790 are shown for detail.

Figure 18:
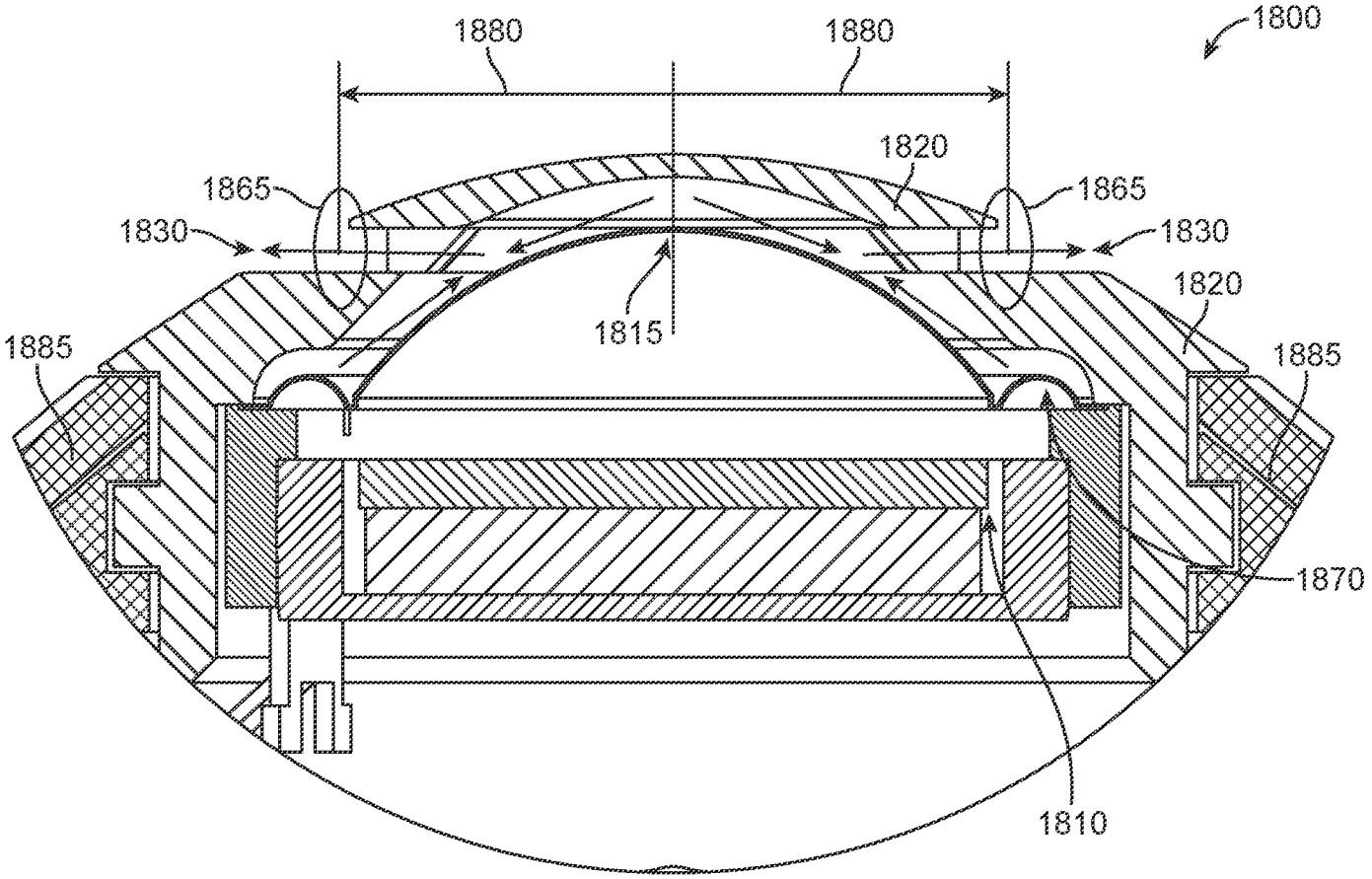
FIG. 18 shows a dome speaker with a straight center tap phase plug, according to an embodiment.

FIG. 18 shows a dome speaker 1800 (e.g., a tweeter) with a straight center tap phase plug 1820, according to an embodiment. In one embodiment, a portion of the phase plug 1820 is positioned over and on the sides of the speaker dome 1815, and the remaining portion extends outward toward the circumference of the speaker enclosure 1885. The path length 1880 is shown from the center of the speaker dome 1815. In one embodiment, the speaker dome 1815 emanates sound waves 1830 that are compressed between the phase plug 1820 and the speaker dome 1815, and forced out through the air paths to the exit 1865 (surrounding the enclosure). As shown, the sound waves 1830 are directed from the dome speaker 1800, and multiple directions are combined to be directed through the air paths to the exit 1865. Additionally, voice coil 1810 and surround 1870 are shown for detail.

Figure 19:
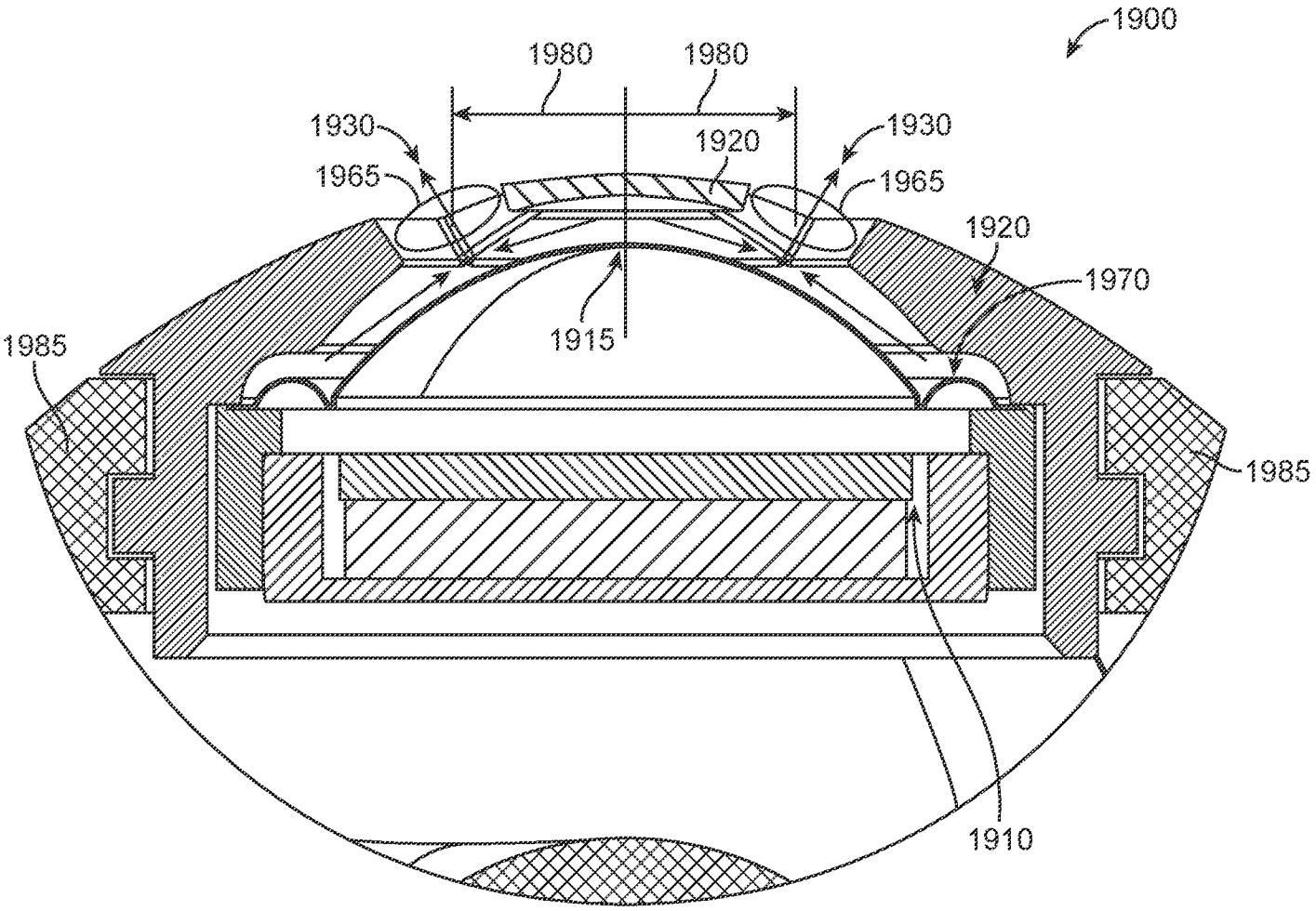
FIG. 19 shows a dome speaker with a normal center tap phase plug, according to an embodiment.

FIG. 19 shows a dome speaker 1900 (e.g., a tweeter) with a normal center tap phase plug 1920, according to an embodiment. In one embodiment, a portion of the phase plug 1920 is positioned over and on the sides of the speaker dome 1915 with the exits 1965 positioned normal to the diaphragm surface(as opposed to the side as in FIGS. 17-18), and the remaining portion extends outward toward the circumference of the speaker enclosure 1985. The path length 1980 is shown from the center of the speaker dome 1915. In one embodiment, the speaker dome 1915 emanates sound waves that are compressed between the phase plug 1920 and the speaker dome 1915, and forced out through the air paths to the exit 1965 (surrounding the upper portion of the enclosure 1985). As shown, the sound waves 1930 are directed from the dome speaker 1900, and multiple directions are combined to be directed through the air paths to the exit 1965. Additionally, voice coil 1910 and surround 1970 are shown for detail.

Figure 20:
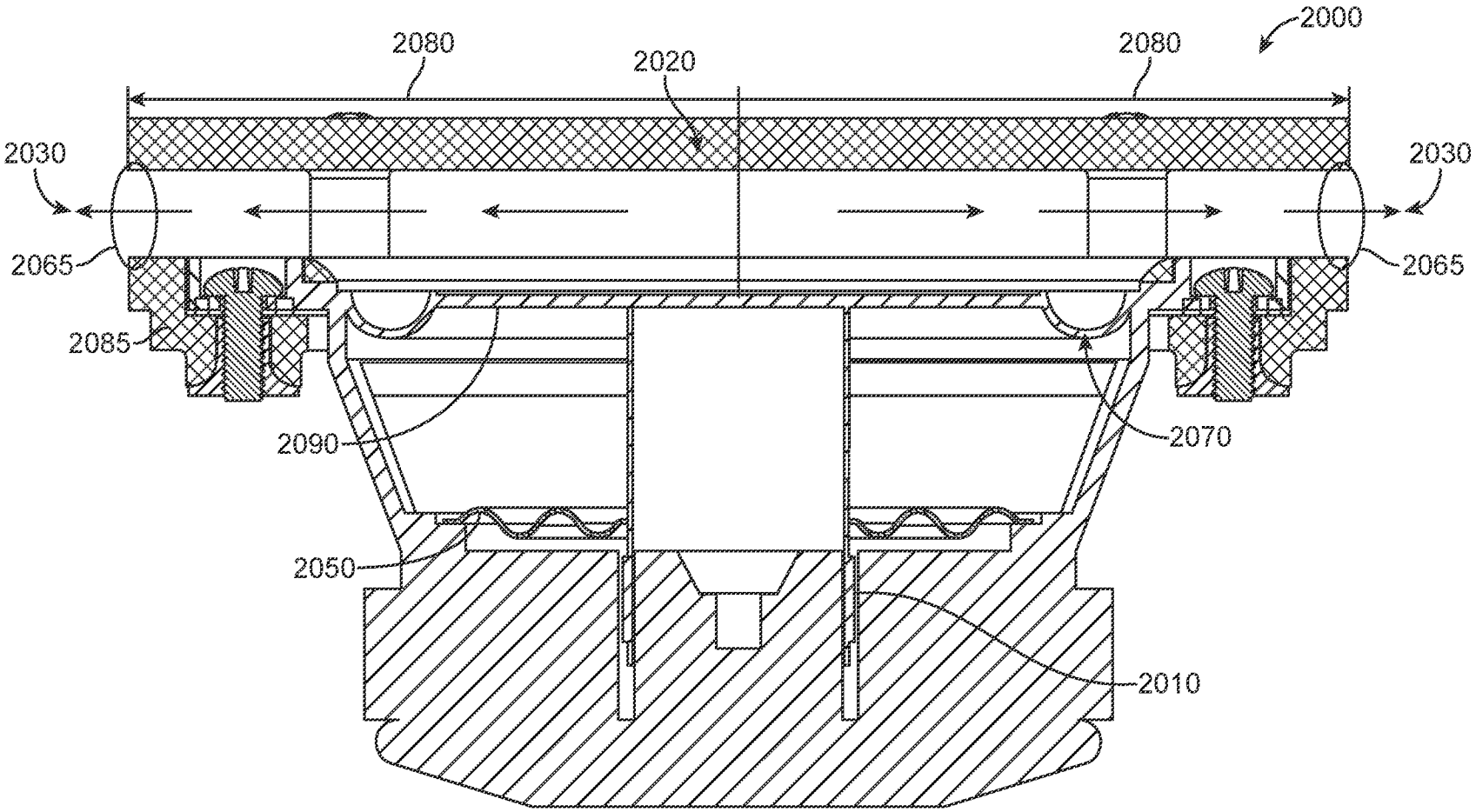
FIG. 20 shows an end tapped flat transducer with a flat phase plug, according to an embodiment.

FIG. 20 shows an end tapped flat transducer 2000 (e.g., speaker) with a flat phase plug 2020, according to an embodiment. In one embodiment, a portion of the phase plug 2020 is positioned over the flat speaker diaphragm 2090, the remaining portion extends outward toward the circumference of the speaker enclosure, and the end tapped air paths flow straight outward toward the circumference of the speaker enclosure. In one embodiment, the flat speaker diaphragm 2090 moves forward (i.e., upward) and back downward (with the help of the spider 2050), and compresses the sound between phase plug 2020 and the flat speaker diaphragm 2090 for forcing the sound waves 2030 out through the air paths to the exit 2065 (surrounding the enclosure). Additionally, voice coil 2010, surround 2070 and transducer mounting plate 2085 are shown for detail. The path length 2080 is also shown in comparison to the air paths.

Figure 21A:
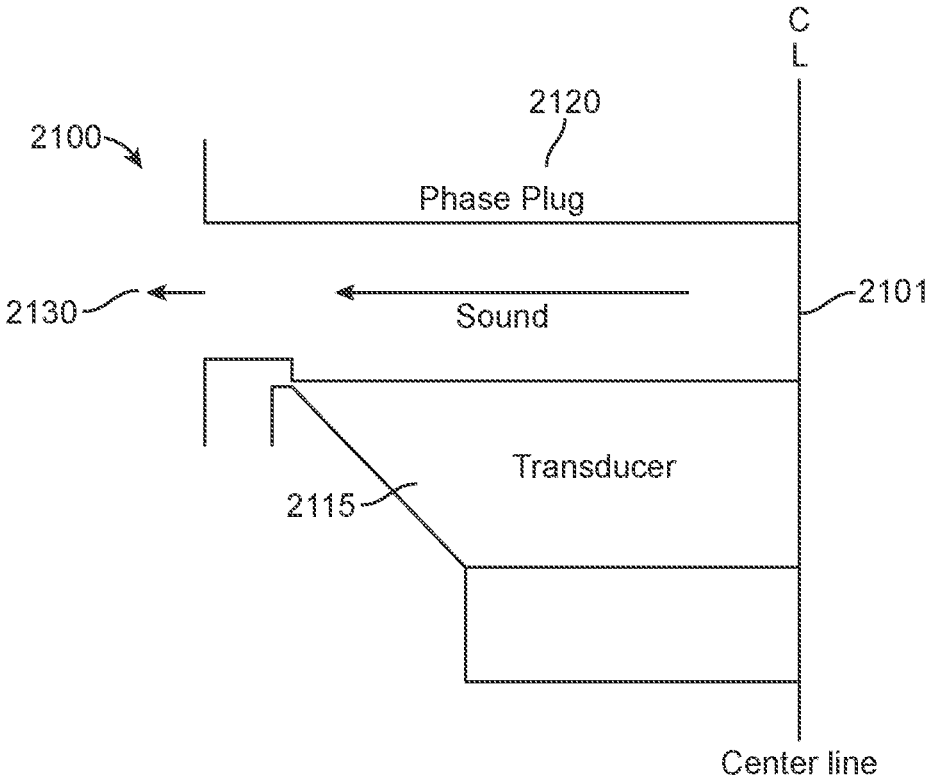
FIGS. 21A-B show comparison of phase plugs with different types of taps, according to an embodiment.
Figure 21B:
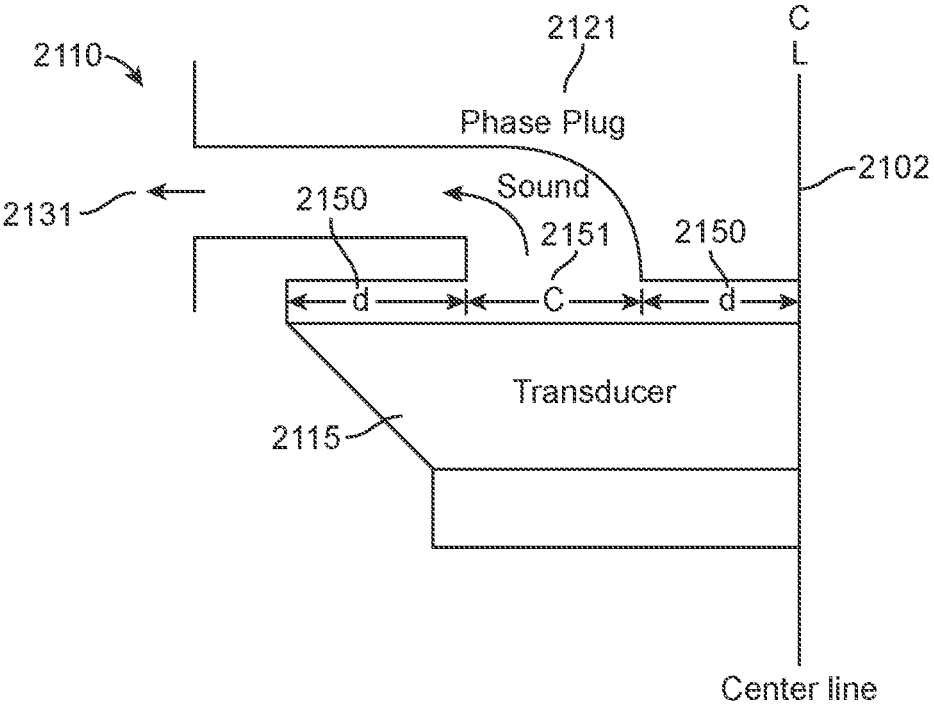
Figure 22:
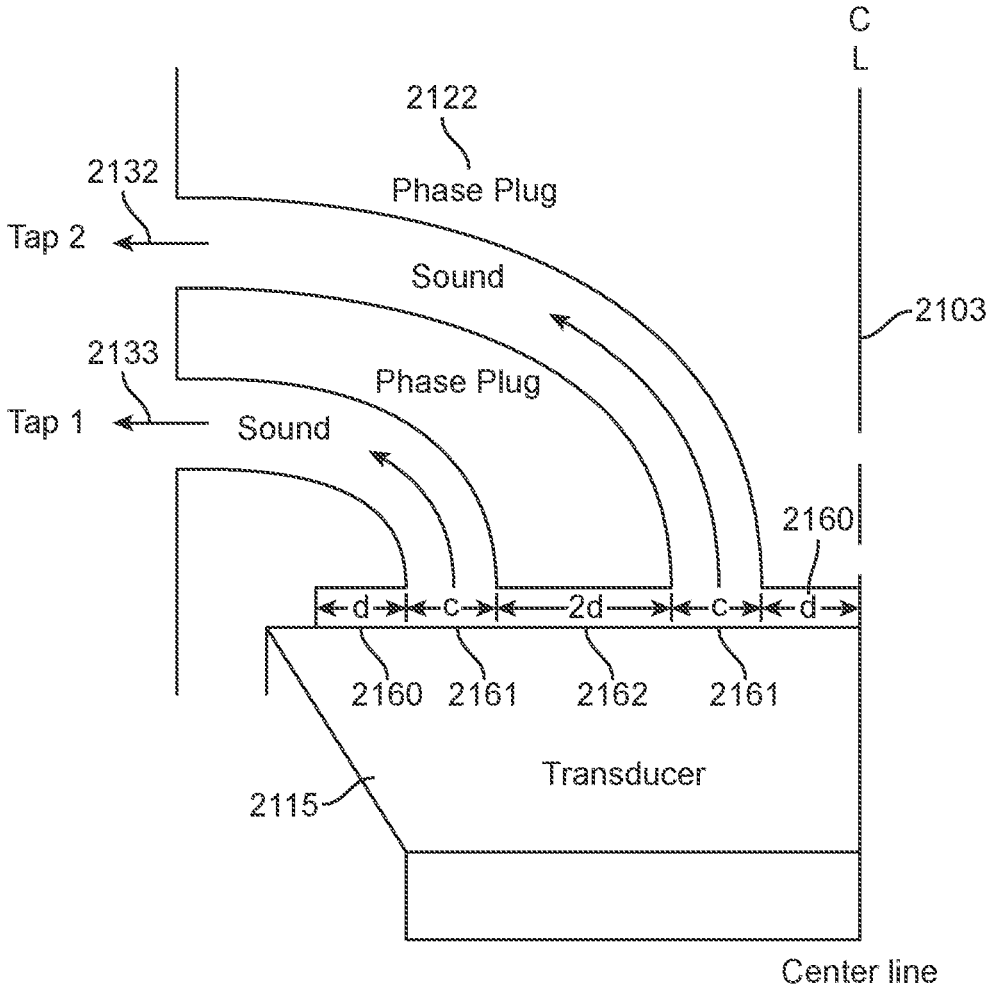
FIG. 22 shows a phase plug with two center taps, according to an embodiment.

FIGS. 21A-B and FIG. 22 show comparison of phase plugs with different types of taps. FIG. 21A shows an example centerline 2101 view of a speaker 2100 including a phase plug 2120 with an end tap showing sound waves 2130 produced from the transducer 2115 flowing in the direction toward the exit of the speaker enclosure.

FIG. 21B shows an example centerline 2102 view of a speaker 2110 including a phase plug 2121 with a single center tap showing sound waves 2131 produced from the transducer 2115 flowing in the direction toward the exit of the speaker enclosure. The distances d 2150 and c 2151 are shown for the respective openings. As shown, the path length d 2150 from the center edge to the start of the exit slot equals the path length d 2150 from the center to the start of the exit slot. In one embodiment, the exit slot may have a width c 2151 that is less than or greater than distance d 2150.

FIG. 22 shows a phase plug 2122 with two center taps 2132 and 2133, according to an embodiment. As shown, the path length d 2160 from the center 2103 edge to the start of the exit slot equals the path length d 2160 from the end to the start of the exit slot. In one embodiment, the exit slots may have a width c 2161 that is less than or greater than distance d 2160. In one embodiment, the distance c 2161 may be equal to or less than, or greater than the distance d 2161. In one embodiment, the phase plug 2122 center portion has a length 2162 equal to 2×d 2162.

Figure 23:
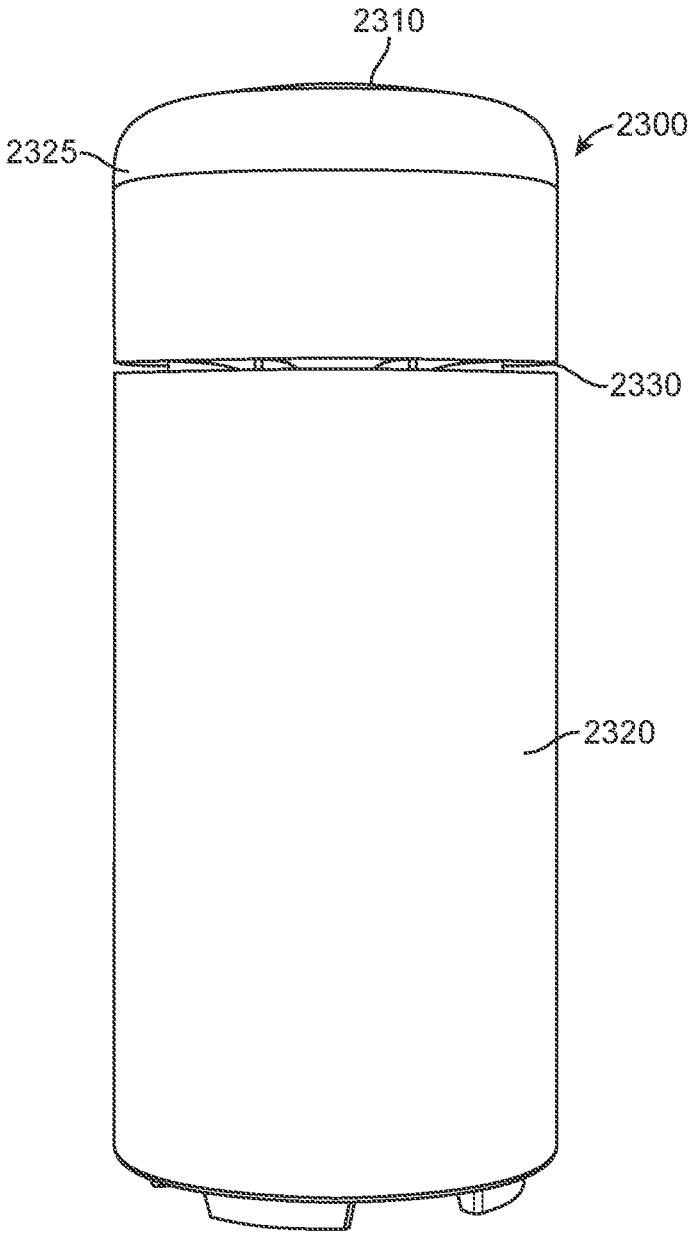
FIG. 23 shows a cylindrical shaped speaker system implementing a ring radiator compression driver, according to an embodiment.

FIG. 23 shows a cylindrical shaped speaker system 2300 implementing a ring radiator compression driver, according to an embodiment. As shown, a portion of the phase plug maybe viewed through the ring-like exit 2330 surrounding the cylindrical shaped enclosure. In one example, a tweeter 2325 may be positioned at the top of the cylindrical shaped speaker system and include an exit 2310. In one embodiment, a driver (e.g., a woofer or midrange) speaker 2320 is positioned below the exit 2330.

Figure 24:
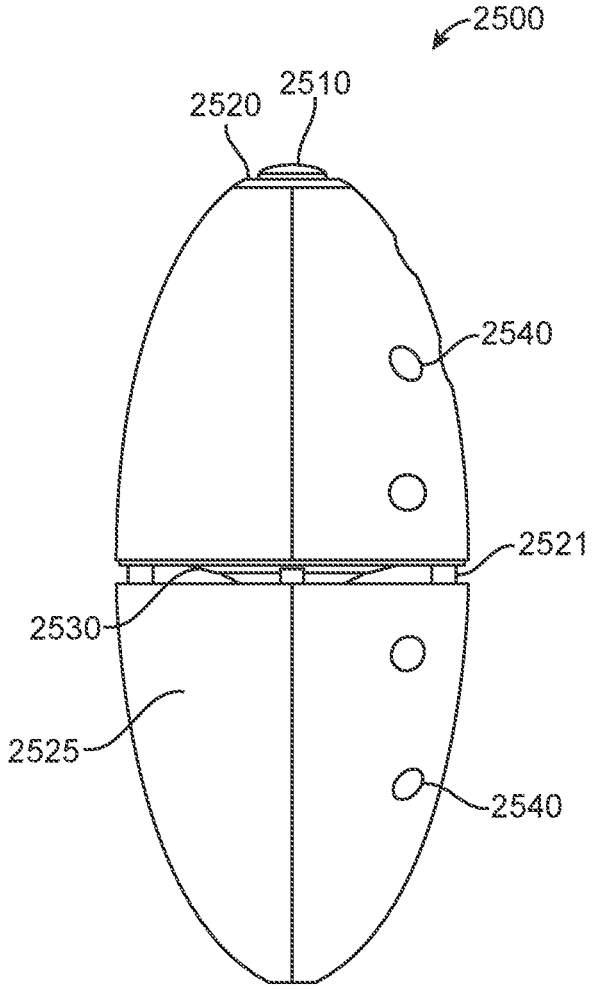
FIG. 24 shows an elliptical shaped speaker system implementing a ring radiator compression driver, according to an embodiment.

FIG. 24 shows an elliptical shaped speaker system 2500 implementing a ring radiator compression driver, according to an embodiment. As shown, a portion of the phase plug 2530 may be viewed through the ring-like exit 2521 surrounding the cylindrical shaped enclosure. In one example, the elliptical shaped speaker system 2500 includes the tweeter 2520 positioned at the top of the cylindrical shaped speaker system with an exit 2510, and a woofer or midrange speaker 2525 may be positioned near the ring-like exit 2521. In other examples, a midrange speaker and a woofer speaker may be positioned (e.g., spaced apart) within the elliptical enclosure. Another embodiment may only have one full-range speaker.

In one example, the elliptical shaped speaker system 2500 may include a flat lower portion for placement on a surface, or an opening to receive a stand at the bottom portion. In one example, the elliptical shaped speaker system 2500 enclosure includes openings or screws/bolts 2540 (e.g., threaded openings, non-threaded openings, fasteners, etc.) for receiving connectors or connecting with connectors for mounting the speaker enclosure to a stand or plate, such as a table stand, a wall plate, etc.

Figure 25:
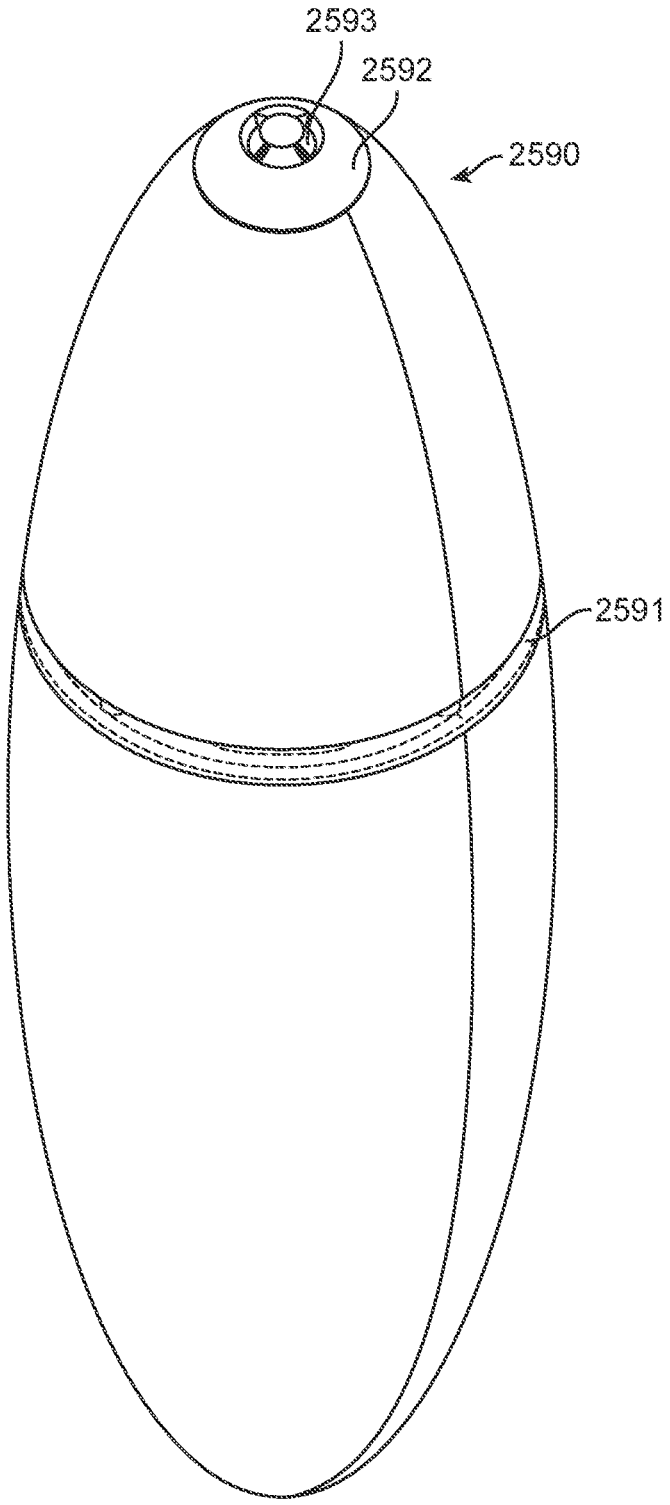
FIG. 25 shows another elliptical shaped speaker system implementing a ring radiator compression driver, according to an embodiment.

FIG. 25 shows another elliptical shaped speaker system 2590 implementing a ring radiator compression driver, according to an embodiment. In one example, the elliptical shaped speaker system 2590 includes the tweeter 2592 positioned at the top of the cylindrical shaped speaker system with an exit 2593, and a woofer or midrange speaker may be positioned near the ring-like exit 2591, which is offset from the center height of the elliptical shaped speaker system 2590 enclosure. In other examples, a midrange speaker and a woofer speaker may be positioned (e.g., spaced apart) within the elliptical enclosure. Another embodiment may only have one full-range speaker. In one example, the elliptical shaped speaker system 2592 may include a flat lower portion for placement on a surface, or an opening to receive a stand at the bottom portion. In one example, the elliptical shaped speaker system 2590 may include fastening elements, such as screws, connectors, bolts, openings (e.g., threaded), etc. for mounting the elliptical shaped speaker system 2590.

Figure 26:
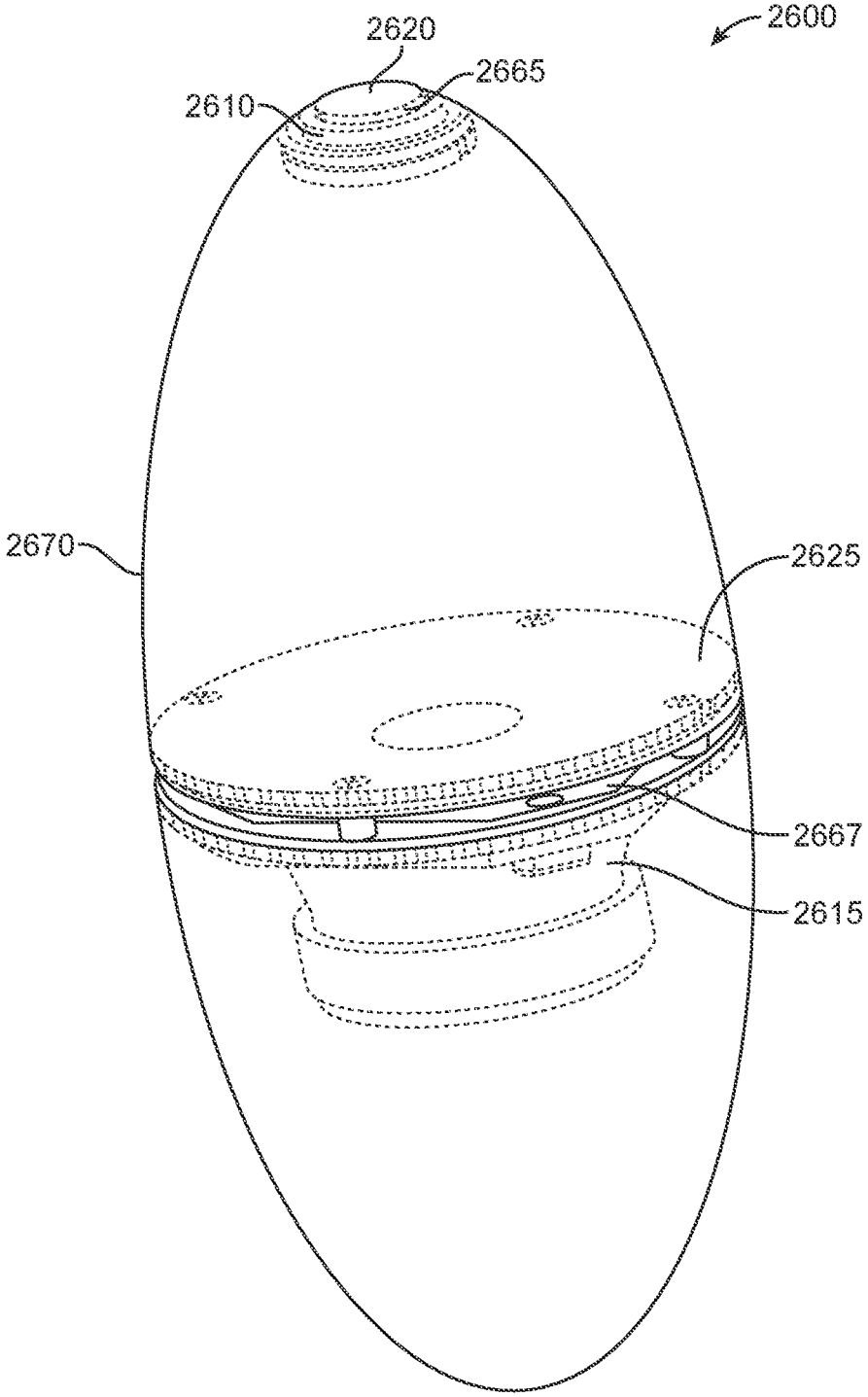
FIG. 26 shows a see through view of an elliptical shaped speaker system implementing a ring radiator compression driver, according to an embodiment.
Figure 27:
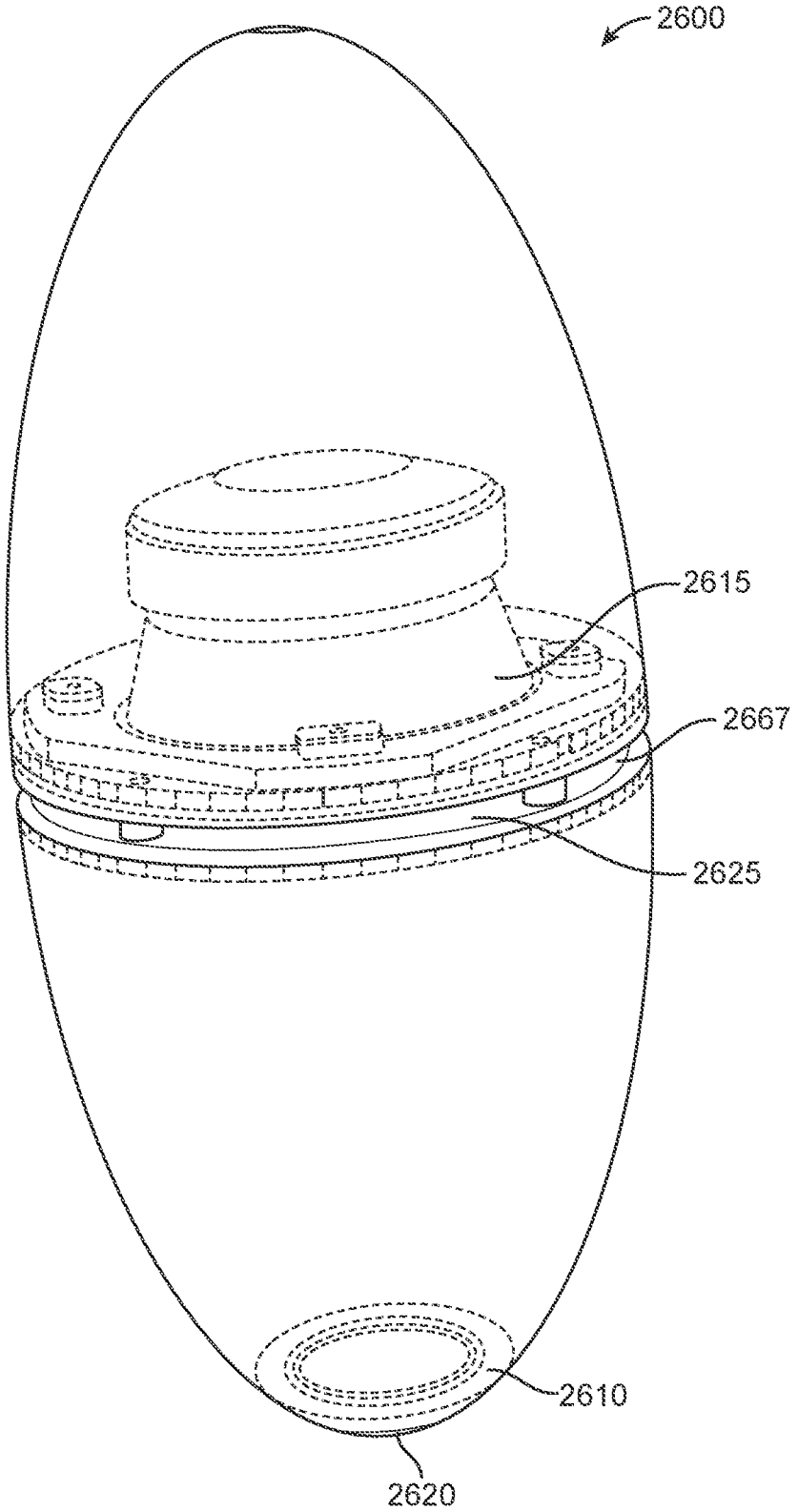
FIG. 27 shows a see through view of the elliptical shaped speaker system of FIG. 26 shown upside down, according to an embodiment.
Figure 28:
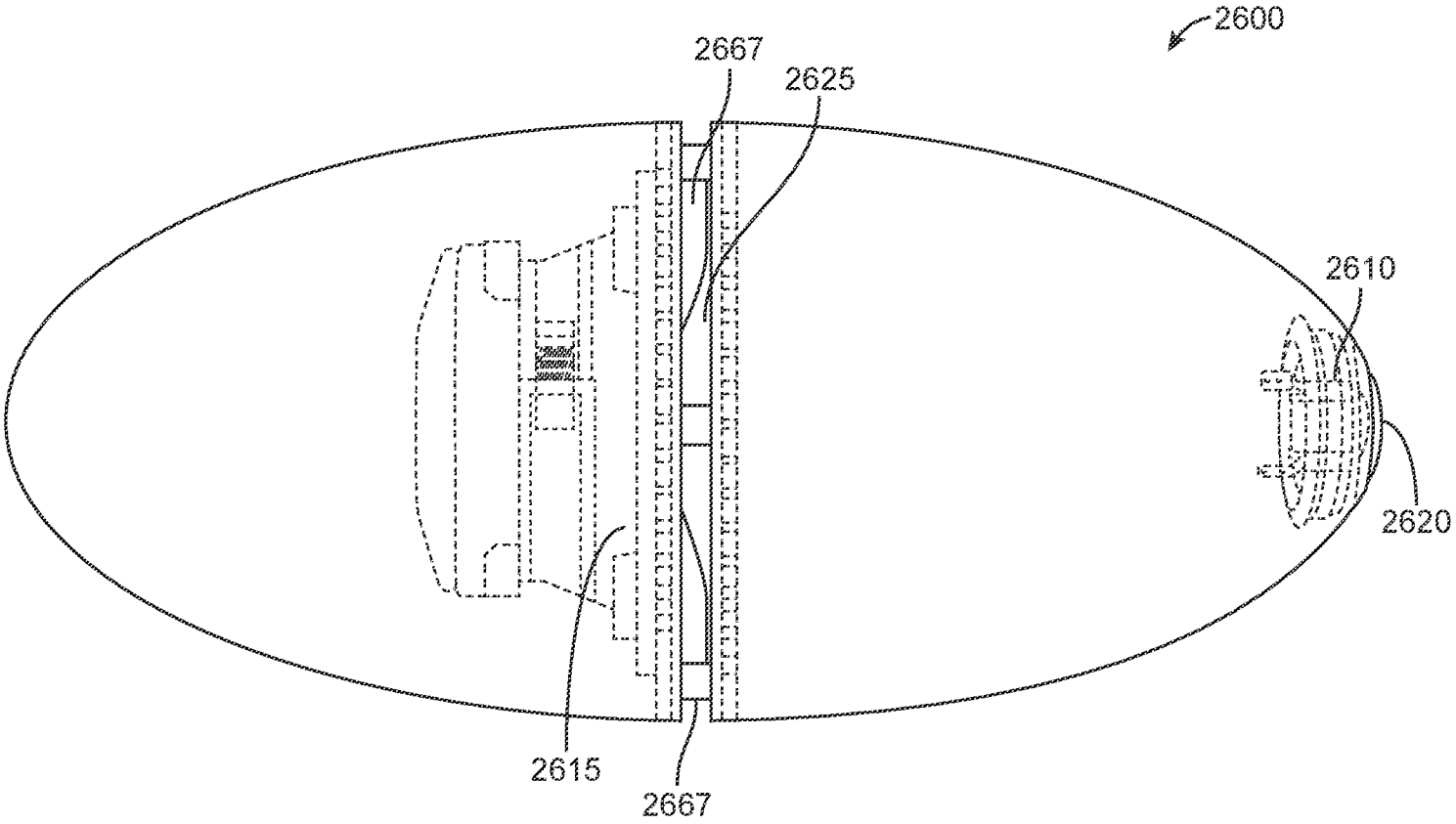
FIG. 28 shows a see through view of the elliptical shaped speaker system of FIG. 26 shown on a side, according to an embodiment.

FIG. 26 shows an example internal front perspective view of an elliptical speaker enclosure system 2600, according to an embodiment. As shown, the lower speaker 2615 uses a phase plug 2625 that is a domed center phase plug. The lower speaker 2615 (e.g., a woofer) is disposed within the elliptical shaped enclosure 2670 and has an exit 2667 for the sound waves to travel outward. The upper speaker 2610 (e.g., a tweeter) has an exit 2665 and includes a phase plug 2620, which may comprise an end phase plug (FIG. 17), straight center tap phase plug (FIG. 18) or normal center tap phase plug (FIG. 19). FIG. 27 shows a see through view of the elliptical shaped speaker system 2600 shown upside down, according to an embodiment. FIG. 28 shows an example internal side view of the elliptical speaker enclosure system 2600, according to an embodiment.

Figure 29A:
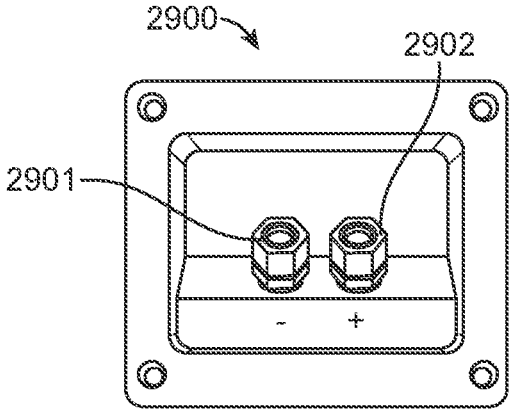
FIGS. 29A-B shows speaker wire connectors that may be used with one or more embodiments.
Figure 29B:
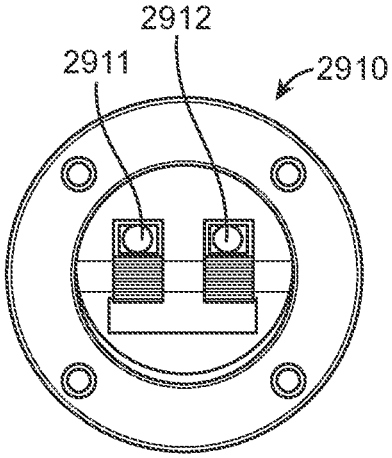

FIGS. 29A-B show example wiring connectors for one or more embodiments. FIG. 29A shows a basic plug or wire connectors 2900 that may be employed by one or more speaker systems. For a plug connector, the plug from a receiver/amplifier is plugged into the receptacles (positive 2902 and negative terminals 2901). For speaker wires, the cap is loosened on the positive terminal 2902 and the negative terminal 2901 and the wires may be placed in a through-hole in the respective terminals. The caps are then tightened securing the speaker wires.

FIG. 29B shows an example 2910 of spring clamps 2911 and 2912 that may be employed by one or more speaker system embodiments. For the spring clamp type connectors 2910, the lever is pressed which opens the slot for inserting a speaker wire. When the wire is inserted, the lever is released which causes the spring clamp to press against the wire to secure the wire.

It should be noted that conventional wiring within the various embodiments of speaker enclosures and combinations of speakers may be employed, including any type of crossover design, delay systems, control systems, separation, impedance components, etc. Thus, different embodiments may be designed for different types of uses (e.g., 4 ohms, 8 ohms, etc.). Additionally, dual drivers may be employed instead of single drivers, multiple speaker types may be matched together (i.e., multiple tweeters, midranges, woofers, etc.).

One or more speaker embodiments may include media processing devices/modules (e.g., streaming audio/video receiving devices/modules), such as hardware, software, firmware, or any combination, and communication processing devices (e.g., BlueTooth® devices, Wi-Fi devices, cellular receiving devices, etc.) for receiving streaming media (e.g., audio/video/text, etc.) directly from a source, such as a server, cloud-based service, other electronic device (e.g., smart phones, television devices, audio players, radio stations, streaming media stations), etc.

One or more speaker embodiments may include a user interface (UI) for controlling receiving and playing of media or media streams. In one embodiment, the UI may include touch controllers, voice control interaction using one or more microphones, a display or touch screen, etc. One or more speaker embodiments may include circuitry for receiving/transmitting cellular telephone calls and for conversing either via audio or audio/video (e.g., video chat or teleconference), whether handsfree or use of a personal device (e.g., an ear bug, headset, etc.).

One or more embodiments may include TV processing devices and antennae for receiving TV programming via Internet (e.g., through Wi-Fi, cable, satellite or air). Some embodiments may include memory devices for storing media (e.g., audio, audio/video, etc.) for playing in a mobile situation. In one example, the speaker embodiments may include a chargeable battery or power source, solar charging capability, and plug-in (e.g., AC/DC) capability for power sources.

One or more speaker embodiments may include processing devices that may communicate with other electronic devices, such as smart phones for providing information to users, for example, when ambient noise is too high to properly hear with a smart phone speaker. One or more embodiments may include processing and communication devices for communicating with a server or cloud-based service for collecting information regarding use of speaker embodiments, such as type of songs/audio played, time of day for play or use, amount of time a speaker device is used, place of use (e.g., from a Global Positioning Satellite (GPS) device, information on other devices in a location (e.g., from BlueTooth® information), etc.

One or more speaker embodiments may include amplification devices for powered amplification of received audio signals or signal enhancement processing devices. One or more embodiments may include signal processing devices for clarifying/filtering signals that may include noise.

One or more embodiments may include enclosures made from one or more materials, such as plastics, wood, metals, metal alloys, composites, laminates, etc. Additionally, one or more embodiments may include amplifiers that are powered (e.g., USB powered, DC powered, AC powered, etc.).

Figure 30:
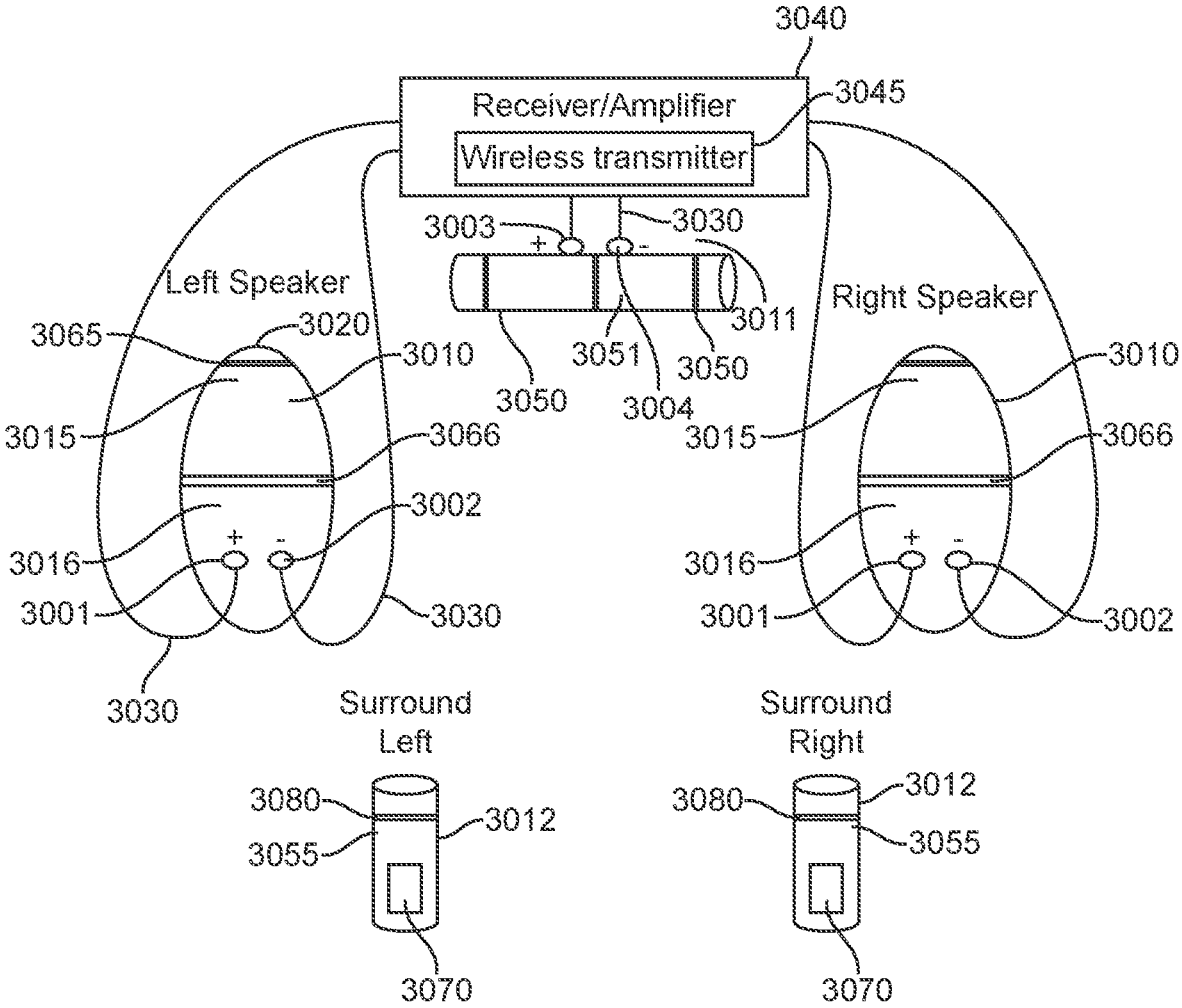
FIG. 30 shows a high level view of a system including multiple embodiments that implement ring radiator compression drivers, according to an embodiment.

FIG. 30 shows a high level view of an example system employing multiple embodiments of speaker systems including ring radiator compression drivers for sound reproduction. In the example system, a receiver/amplifier 3040 including a wireless transmitter 3045 is connected to a left speaker 3010, a right speaker 3010, a center (channel) speaker 3011, a left wireless surround speaker 3012 and a right wireless surround speaker 3012. It should be noted that additional speaker embodiments and/or other components (e.g., subwoofer(s)) may also be added to the example system. In one embodiment, a process, processor, memory, integrated circuit, etc. may be incorporated with any speaker enclosure for sound processing with any combinations of speaker elements (e.g., tweeters, midranges, woofers, etc.).

In one example, the left and right speakers 3010 include a tweeter 3015 having an exit 3065 near the top 3020 of the speaker enclosure. A woofer (or midrange) speaker 3016 is positioned so that sound produced emanates from the exit 3066. The left and right speakers 3010 may have different shapes (e.g., cylindrical, spherical, elliptical (as shown), polygonal, etc.). The left and right speakers have connecting terminals 3001 and 3002 for connecting speaker wires 3030 to the receiver/amplifier 3040.

In one example, the center channel speaker 3011 may include multiple speakers (e.g., tweeter(s), midrange(s), woofer(s)/driver(s), etc.). In the example center channel speaker 3011 shown, tweeters 3050 are positioned at the ends of the center speaker 3011 enclosure, and a midrange speaker 3051 is positioned at or near the center of the speaker enclosure. The center channel speaker 3011 may have different shapes (e.g., cylindrical (as shown), spherical, elliptical, polygonal, etc.). The center channel speaker 3011 has connecting terminals 3003 and 3004 for connecting speaker wires 3030 to the receiver/amplifier 3040.

In one example, the wireless surround speakers 3012 may include multiple speakers (e.g., tweeter(s), midrange(s), woofer(s)/driver(s), etc.). In the example the wireless surround speakers 3012 shown have tweeters 3055 (and/or midrange) that are positioned near the top of the wireless surround speaker 3012 enclosures and an exit 3080 for emanating sound. The wireless surround speakers 3012 may have different shapes (e.g., cylindrical (as shown), spherical, elliptical, polygonal, etc.). The wireless surround speakers 3012 have a wireless receiver 3070 for receiving audio (and communications) from the receiver/amplifier 3040.

Figure 31:
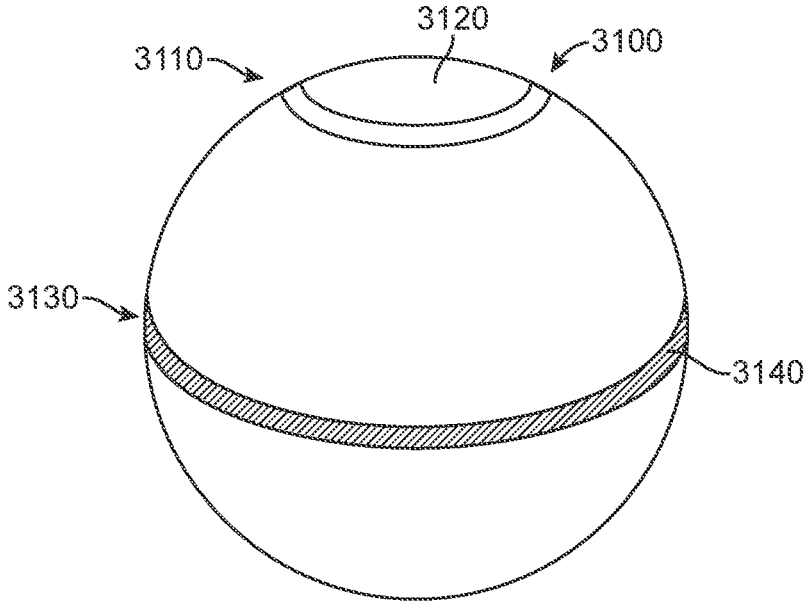
FIG. 31 shows a spherical shaped speaker system implementing a ring radiator compression driver, according to an embodiment.

FIG. 31 shows a spherical shaped speaker system 3100 implementing a ring radiator compression driver, according to an embodiment. In one example, the speaker system 3100 is a two-way (e.g., tweeter and woofer) speaker system including ring radiator compression drivers. In one example, the spherical shaped speaker system 3100 includes a tweeter 3110 with an exit 3120 (for emanating sound) and a woofer 3130 and an exit 3140 (for emanating sound).

Though the embodiments have been described with reference to certain versions thereof; however, other versions are possible. Therefore, the spirit and scope of the appended claims should not be limited to the description of the preferred versions contained herein.

What is claimed is:

1. An omni-directional speaker apparatus comprising:

a speaker enclosure including a sound wave exit configured to emit sound waves omni-directionally;

a transducer coupled to the speaker enclosure, the transducer comprising a speaker diaphragm coupled to a mounting plate; and a phase plug that directs sound to the sound wave exit, the phase plug comprising a first portion that extends outwards toward an exterior of the speaker enclosure, wherein the phase plug comprises one of a center pole phase plug, a domed center phase plug, an inverted domed center phase plug, an end tap phase plug, a center tap phase plug, a multi-tap phase plug, or a flat phase plug.

2. The omni-directional speaker apparatus of claim 1, wherein the sound wave exit is a peripheral sound wave exit.

3. The omni-directional speaker apparatus of claim 2, wherein the mounting plate is disposed adjacent the peripheral sound wave exit.

4. The omni-directional speaker apparatus of claim 1, wherein the phase plug further comprising a second portion positioned substantially parallel and adjacent to at least part of the speaker diaphragm.

5. The omni-directional speaker apparatus of claim 1, wherein the speaker diaphragm comprises an outer portion that is coupled to the mounting plate.

6. The omni-directional speaker apparatus of claim 1, wherein the transducer comprises an end tapped speaker cone, and the phase plug is a center phase plug that comprises one of a center pole phase plug, a domed center phase plug, or an inverted domed center phase plug.

7. The omni-directional speaker apparatus of claim 1, wherein the transducer comprises a center tapped speaker cone-and the phase plug is a domed center phase plug.

8. The omni-directional speaker apparatus of claim 1, wherein the transducer comprises a dome speaker and the phase plug is a tap phase plug that comprises one of an end tap phase plug, a straight center tap phase plug, or a center tap phase plug.

9. The omni-directional speaker apparatus of claim 1, wherein the transducer comprises an end tapped flat speaker.

10. The omni-directional speaker apparatus of claim 1, wherein the sound wave exit comprises an opening around a perimeter of the speaker enclosure.

11. The omni-directional speaker apparatus of claim 1, further comprising one or more other drivers coupled to the speaker enclosure.

12. An omni-directional speaker system comprising:

a speaker enclosure including a first sound wave exit and a second sound wave exit to emit sound waves omni-directionally;

a first transducer coupled to the speaker enclosure, the first transducer comprising:

a speaker diaphragm coupled to a mounting plate; and a first phase plug that directs sound to the first sound wave exit, the first phase plug comprising a first portion positioned adjacent to at least part of the speaker diaphragm and a second portion that extends outwards toward an exterior of the speaker enclosure; and a second transducer;

wherein the first phase plug comprises one of a center pole phase plug, a domed center phase plug, an inverted domed center phase plug, an end tap phase plug, a center tap phase plug, a multi-tap phase plug, or a flat phase plug.

13. The omni-directional speaker system of claim 12, wherein the first sound wave exit is a peripheral sound wave exit, and the mounting plate is disposed adjacent the peripheral sound wave exit.

14. The omni-directional speaker system of claim 12, wherein the first portion of the first phase plug is positioned substantially parallel to the at least part of the speaker diaphragm, and the speaker diaphragm comprises an outer portion that is coupled to the mounting plate.

15. The omni-directional speaker system of claim 12, wherein the second transducer comprises a speaker coupled with a second phase plug.

16. The omni-directional speaker system of claim 15, wherein the first transducer comprises an end tapped cone speaker and the first phase plug is a center phase plug that comprises one of a center pole phase plug, a domed center phase plug, or an inverted domed center phase plug.

17. The omni-directional speaker system of claim 15, wherein:

the first transducer comprises a center tapped cone speaker and the first phase plug is a domed center phase plug; and the second transducer comprises a dome speaker and the second phase plug comprises one of an end tap phase plug, a straight center tap phase plug, or a center tap phase plug.

18. The omni-directional speaker system of claim 15, wherein:

the first transducer comprises an end tapped flat speaker.

19. A method comprising:

positioning a sound wave exit on a speaker enclosure to emit sound waves omni-directionally;

attaching a transducer to the speaker enclosure, the speaker transducer including a speaker diaphragm having a portion coupled to a mounting plate disposed adjacent the sound wave exit;

positioning a first portion of a phase plug that directs sound to the sound wave exit adjacent to at least part of the speaker diaphragm; and positioning a second portion of the phase plug that extends outwards toward an exterior of the speaker enclosure;

wherein the phase plug comprises one of a center pole phase plug, a domed center phase plug, an inverted domed center phase plug, an end tap phase plug, a center tap phase plug, a multi-tap phase plug, or a flat phase plug.

20. The method of claim 19, wherein:

positioning the first portion of the phase plug further comprising positioning the first portion substantially parallel to the at least part of the speaker diaphragm.

* * * * *